US011980283B2

(12) United States Patent
Erbeli

(10) Patent No.: US 11,980,283 B2
(45) Date of Patent: May 14, 2024

(54) TRI-POSITION HAIRBRUSH

(71) Applicant: Iliran Erbeli, South Amboy, NJ (US)

(72) Inventor: Iliran Erbeli, South Amboy, NJ (US)

( * ) Notice: Subject to any disclaimer, the term of this patent is extended or adjusted under 35 U.S.C. 154(b) by 735 days.

(21) Appl. No.: 17/198,297

(22) Filed: Mar. 11, 2021

(65) Prior Publication Data

US 2021/0282539 A1 Sep. 16, 2021

Related U.S. Application Data

(60) Provisional application No. 62/988,399, filed on Mar. 12, 2020.

(51) Int. Cl.

| | |
|---|---|
| ***A46B 7/02*** | (2006.01) |
| ***A46B 5/00*** | (2006.01) |
| ***A46B 9/02*** | (2006.01) |

(52) U.S. Cl.

CPC ..... *A46B 7/02* (2013.01); *A46B 5/0025* (2013.01); *A46B 5/0041* (2013.01);

(Continued)

(58) Field of Classification Search

CPC ..... A46B 7/02; A46B 7/023; A46B 7/026; A46B 5/002; A46B 5/0033; A46B 9/023; A45D 24/06

(Continued)

(56) References Cited

U.S. PATENT DOCUMENTS 444,710 A * 1/1891 McPherson ..... A61C 17/24 15/179

1,189,698 A 7/1916 Keating (Continued)

FOREIGN PATENT DOCUMENTS

CN 201398601 Y 2/2010
DE 3602052 A1 7/1987

(Continued)

OTHER PUBLICATIONS

Ali Express, "Portable Folding Hair Brush With Mirror Compact Pocket Size Comb For Purse Bag" Printed from the Internet on Apr. 19, 2021 from: https://www.aliexpress.com/item/32812723932.html.

(Continued)

*Primary Examiner* — Eric J Rosen

*Assistant Examiner* — Aaron R McConnell

(74) *Attorney, Agent, or Firm* — AlphaPatent Associates Ltd.; Daniel J. Swirsky

(57) ABSTRACT

A tri-position hairbrush includes a modular bristle-bed, having a plurality of bristles connected thereto; and a handle, connected to the modular bristle-bed. A switching unit operates to switch and convert the modular bristle-bed among three operational states. In a first operational state, which is a Closed State, the modular bristle-bed is arranged as a cylindrical structure that spans 330 to 360 degrees of curvature, and the hairbrush operates a round hairbrush. In a second operational state, which is a Semi-Open State, the modular bristle-bed is arranged as a curved cylinder-portion of 150 to 210 degrees of curvature, and the hairbrush operates as an open-curve hairbrush. In a third operational state, which is a Fully-Open State, the modular bristle-bed is arranged as a generally-flat surface, and the hairbrush operates as a paddle hairbrush.

20 Claims, 60 Drawing Sheets

(52) U.S. Cl.
CPC ..... *A46B 5/0083* (2013.01); *A46B 9/023* (2013.01); *A46B 2200/104* (2013.01)

(58) Field of Classification Search
USPC ..... 15/184, 185, 201, 203
See application file for complete search history.

(56) References Cited

U.S. PATENT DOCUMENTS

| | | | | |
|---|---|---|---|---|
| 1,231,093 | A | 6/1917 | Sundeen | |
| 3,931,826 | A | 1/1976 | Moon | |
| 3,947,914 | A | 4/1976 | Jacoby | |
| 4,028,768 | A | 6/1977 | Pascal | |
| 4,250,590 | A | 2/1981 | Chiang | |
| 4,423,531 | A * | 1/1984 | Wall | A46B 3/005 132/129 |
| 4,498,211 | A | 2/1985 | Bottolfson | |
| 4,500,939 | A * | 2/1985 | Gueret | A46B 15/0051 15/207.2 |
| 4,554,699 | A * | 11/1985 | Simmons | B25G 3/24 15/160 |
| 5,335,390 | A | 8/1994 | Chen | |
| 6,595,219 | B2 | 7/2003 | Anderson | |
| 8,302,246 | B2 | 11/2012 | Chudzik | |
| 2010/0200011 | A1 | 8/2010 | Wynne | |
| 2011/0056505 | A1 * | 3/2011 | Parkinson | A46B 9/028 15/160 |
| 2014/0366910 | A1 | 12/2014 | Habibi | |
| 2015/0216286 | A1 * | 8/2015 | Wolfsgruber | A46B 9/026 401/122 |
| 2015/0366325 | A1 * | 12/2015 | Wolfsgruber | A46B 7/02 401/122 |
| 2015/0366326 | A1 * | 12/2015 | Hauger | A46B 7/023 401/122 |
| 2016/0022021 | A1 * | 1/2016 | Kurani | A46B 7/02 15/172 |

FOREIGN PATENT DOCUMENTS

| | | | |
|---|---|---|---|
| DE | 8800661 | U1 | 3/1988 |
| GB | 2540555 | A | 1/2017 |
| KR | 20120081670 | A | 7/2012 |
| KR | 101410431 | B1 | 6/2014 |

OTHER PUBLICATIONS

Machine Translation of KR 20120081670 A Obtained on Apr. 19, 2021 from: https://patents.google.com/patent/KR20120081670A/en.
Machine Translation of DE 3602052 A1 Obtained on Apr. 19, 2021 from: https://patents.google.com/patent/DE3602052A1/en.
Machine Translation of KR 101410431 B1 Obtained on Apr. 19, 2021 from: https://patents.google.com/patent/KR101410431B1/en.
Machine Translation of CN 201398601 Y Obtained on Apr. 19, 2021 from: https://patents.google.com/patent/CN201398601Y/en.
Machine Translation of DE 8800661 U1 Obtained from "Google Translate" on Apr. 19, 2021.

* cited by examiner ( Section C - C )

( Section B - B )

( Section A - A )

( Section A - A )

( Section A - A )

( Section C - C )

( Section B - B )

( Section A - A )

( Section A - A )

( Section C - C )

( Section B - B )

1400

TRI-POSITION HAIRBRUSH

CROSS-REFERENCE TO RELATED APPLICATIONS

This patent application claims priority and benefit from U.S. 62/988,399, filed on Mar. 12, 2020, which is hereby incorporated by reference in its entirety.

FIELD

Some embodiments are related to hairbrushes and hair-styling devices.

BACKGROUND

A hairbrush is a device having bristles and typically a handle, typically utilized for hair care purposes. For example, a hairbrush is used for detangling tangled hair, for smoothing hair, for styling or shaping hair, or the like. Some people utilize a hairbrush in combination with other devices, for example, with a hair dryer or with a curling iron. Hairbrushes are utilized by millions of people worldwide, including female users, male users, children, as well as professionals such as barbers, hairdressers, haircutters, hair stylists, cosmetologists, and other professionals.

SUMMARY

Some embodiments include a tri-state hairbrush, including a switching mechanism able to switch the hairbrush among a first operational state, a second operational state, and a third operational state.

In the first operational state ("closed state"), a bristle bed of the hairbrush is cylindrical or is generally cylindrical or is barrel-shaped, and the tri-position hairbrush is operable as a round hairbrush.

In the second operational state ("semi-open state"), the bristle bed is shaped as a semi-cylinder or as a curved cylinder-portion of approximately 180 degrees (or other suitable value; such as, in the range of 150 to 210 degrees); and the tri-position hairbrush is operable as an open-curve hairbrush.

In the third operational state ("fully-open state"), the bristle bed is shaped as a flat or generally-flat surface, or as an almost-flat surface; and the tri-position hairbrush is operable as a paddle hairbrush.

A switch or switching mechanism, or an actuator or actuating mechanism, enables a user to selectively switch the hairbrush from the first operational state to the second operational state (or vice versa), and from the second operational state to the third operational state (or vice versa).

A lock/unlock mechanism, such as a pin or latch or other locking/unlocking element, may firmly lock in place the hairbrush in one of the three positions; may be released by the user in order to enable transition from one position to another position; and may then firmly lock again the hairbrush in such other position.

Some embodiments may provide other and/or additional benefits or advantages.

DETAILED DESCRIPTION OF SOME DEMONSTRATIVE EMBODIMENTS

Figure 1A:
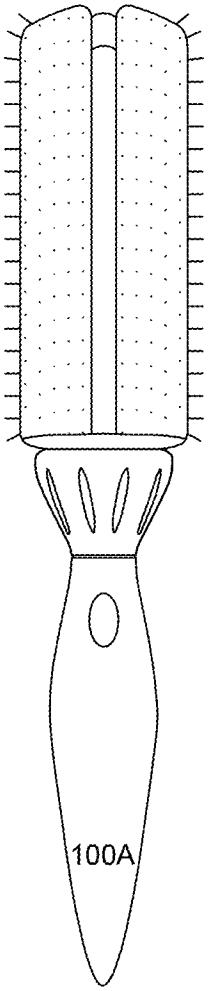
FIGS. 1A-1F are illustrations of views of multiple operational states of a tri-position hairbrush, in accordance with some demonstrative embodiments.
Figure 1B:
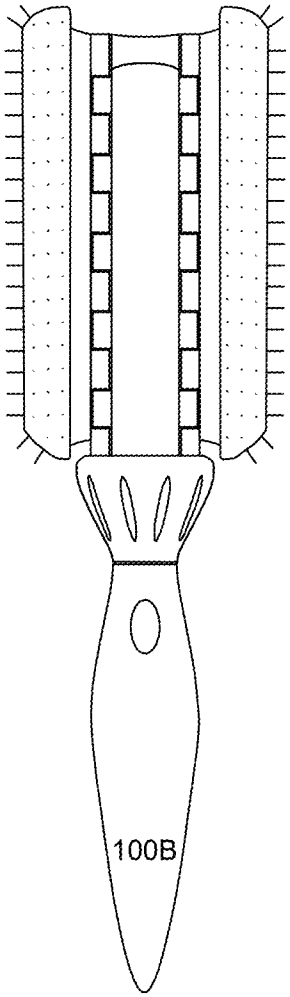
Figure 1C:
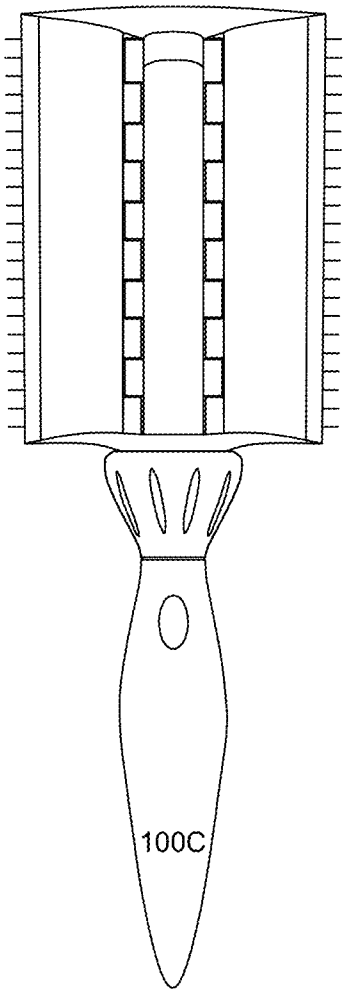
Figure 1D:
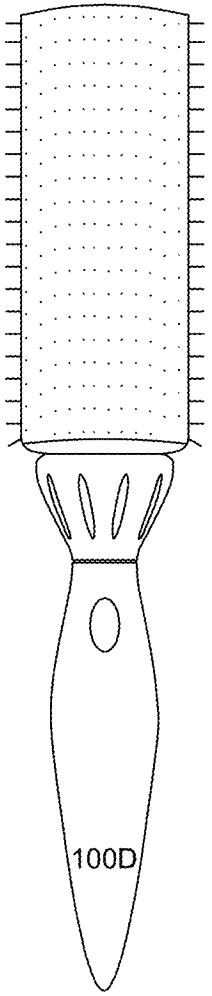
Figure 1E:
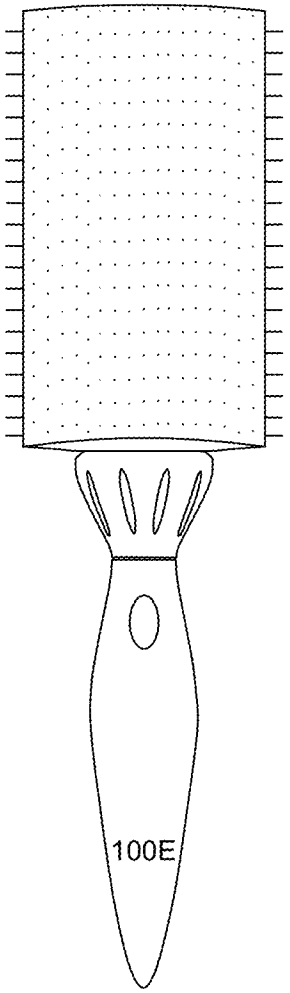
Figure 1F:
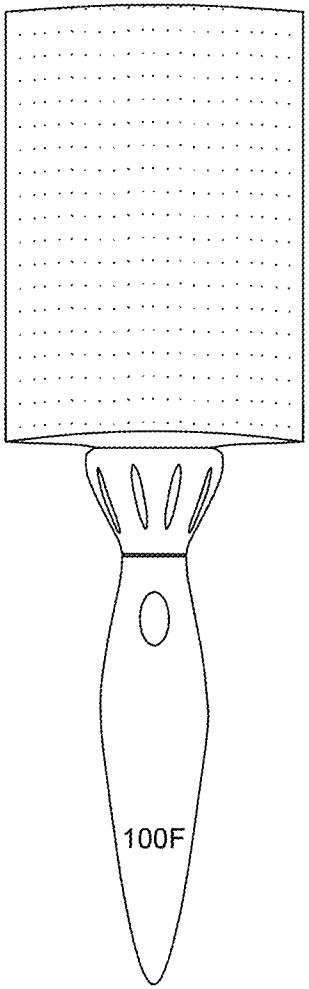

The Applicants have realized that different types of hairbrushes are particularly useful for achieving particular goals or for performing particular hair-styling tasks, by a conventional user or by a professional user.

For example, the Applicants have realized that a cylindrical "Round Hairbrush" is useful to tame frizz, to deliver bounce and/or volume (especially at the roots of the hair), and/or to create rounded contours in hair strands (e.g., ranging from gentle bends and waves, to curls), Additionally, the Applicants have realized that an "Open-Curve Hairbrush" is useful for creating hairstyles characterized by soft, gently curved, natural-looking lines (e.g., as opposed to well-defined waves or curls).

Furthermore, the Applicants have realized that a "Paddle Hairbrush" is useful to achieve straight or generally-straight hairstyles, as well as for basic blow-drying that is not directed to creating a distinctive style, and also for smoothing and/or detangling dry hair.

The Applicants have realized that, as a result of the above differentiation, a home user or a professional user may need to purchase, own, store and/or maintain three different brushes, to efficiently achieve the various different goals that each different brush is suitable to provide. As a result, realized the Applicants, a user needs to purchase three brushes, in order to efficiently achieve three different types of tasks, thereby tripling the cost that the user needs to spend.

Furthermore, the user needs to keep and store three distinct hairbrushes, on her shelf or table or in her drawer or purse, or in his robe pocket or work vest, thereby demanding an increased storage volume, as well as increased weight that the user stores or sometimes carries on his body.

Additionally, a user that wishes to switch from a first goal to a second goal, needs to physically put-down the first type of hairbrush, and needs to physically pick-up the second type of hairbrush (and later, the third type of hairbrush), thereby wasting precious time on exchanging hairbrushes, and risking that one of the exchanged hairbrushes would fall to the floor (and thus will break, or will get damaged, or at least will get dirty or contaminated). The need to exchange hairbrushes may also be frustrating for the home user, and/or may waste the precious time of the professional hairstylist as well as his demanding customer.

The Applicants have also realized that owning and utilizing three different and separate hairbrushes, may require a professional hairstylist to sanitize or clean each one of them between customers; for example, by manually removing from three hairbrushes any trapped hair when switching from a first customer to a second customer; thereby making such a transition between customer more time-consuming and more effort-consuming for the haircare professional.

The Applicants have realized that it would be advantageous and beneficial to create a multi-state hairbrush or a multiple-state hairbrush, and particularly a tri-state hairbrush or a triple-state hairbrush, which enables a user to own and operate a single hairbrush that is able to be selectively switched (or converted) among three different operational states corresponding to the three different roles described above, in an efficient manner that will reduce costs, operation time, cleaning efforts, and clutter.

Some embodiments provider a tri-state or tri-mode or tri-position hairbrush, or a triple-state or triple-mode or triple position hairbrush; which a user can switch or modify from being in a first operational state or mode or position, to being in a second operational state or mode or position, to being in a third operational state or mode or position.

Reference is made to FIGS. 1A-1F, which are illustrations of views of multiple operational states or modes or positions of a single tri-position hairbrush, in accordance with some demonstrative embodiments.

The first operational state (100A, 100D) may be referred to as "round position" or "closed state" or "fully-closed position" or "smallest form-factor state"; a bristle bed of the hairbrush is cylindrical or is generally cylindrical or is barrel-shaped or is generally barrel-shaped, and the tri-position hairbrush is operable as a round hairbrush or as a round bristle-bed hairbrush or as a cylindrical bristle-bed hairbrush. The first operational state is demonstrated in a front-view 100A and in a rear-view 100D.

The second operational state (100B, 100E) may be referred to as "curved position" or "semi-open position" or "semi-closed position" or "partially-open state"; the bristle bed is shaped as a semi-cylinder or as a curved cylinder-portion of approximately 180 degrees (or other suitable value; such as, in the range of 150 to 210 degrees; or, approximately 210 degrees, or approximately 240 degrees; or approximately 270 degrees; or in the range of 180 to 270 degrees; or in the range of 180 to 300 degrees; or other suitable value of degrees, or range-of-values); and the tri-position hairbrush is operable as an open-curve hairbrush or as a curved-bed hairbrush or as a curved bristle-bed hairbrush. The second operational state is demonstrated in a front-view 100B and in a rear-view 100E.

The third operational state (100C, 100F) may be referred to as "flat position" or "generally-flat position" or "almost-flat position" or "fully-open position" or "maximal opening state" or "paddle brush position"; the bristle bed is shaped as a flat or generally-flat surface or paddle, or as an almost-flat structure or paddle; and the tri-position hairbrush is operable as a paddle hairbrush. The third operational state is demonstrated in a front-view 100C and in a rear-view 100F.

A switching mechanism or a switch, or an actuating mechanism or actuator unit, and optionally a locking mechanism or a locking/unlocking mechanism, enables the user to selectively switch or modify the hairbrush among the three states or positions described above; and to lock the hairbrush into a particular state of the three states; and to unlock the hairbrush from being locked in a particular state in order to switch the hairbrush to a different state (and then to lock the hairbrush at that different state). The switch or actuator or lock unit may be implemented by utilizing one or more suitable structure-modification units; for example, one or more gears or a set of gears, a slider unit or a sliding mechanism, a push/pull lever or button or pin that can be moved or slid or otherwise engaged from being in a first position or location to being in a second position or location to being in a third position or location, a ratchet and pawl mechanism and/or other suitable mechanisms.

The switch or actuator may, for example, cause the bristle-bed to fold or unfold, to expand or to shrink, to retract, to move, to increase in diameter or size, to decrease in diameter or size, to change an angel between two or more nearby panels or nearby components of the bristle-bed, and/or to otherwise change the spatial structure of the bristle-bed in order to achieve the desired structure that corresponds to one of the three distinct positions of the hairbrush.

The bristle-bed may be implemented, for example, as a set of three or four or five or other number of panels or components, which may be structured initially to form a structure similar to a barrel or a cylinder; and which may be moved or pushed or pulled, via the switch or actuator, to assume and to maintain a different structure, such as the curved structure or the flat structure. In some embodiments, there may be three such panels, and each panel may be a curved panel; for example, spanning approximately 120 degrees, or approximately 115 or 110 degrees, of curvature. In some embodiments, the bristle-bed is structured to comprise three elongated and curved panels; each such panel spanning or covering an arc in the range of 110 to 120 degrees, or 110 to 118 degrees, or 112 to 120 degrees, or 115 to 120 degrees; such that the three panels, in a closed position, form a circular or a cylindrical bristle bed, or form an almost-circular or an almost-cylindrical bristle-bed that does not span the entirety of 360 degrees bur that spans or covers at least 330 or at least 340 or at least 350 degrees.

Figure 2A:
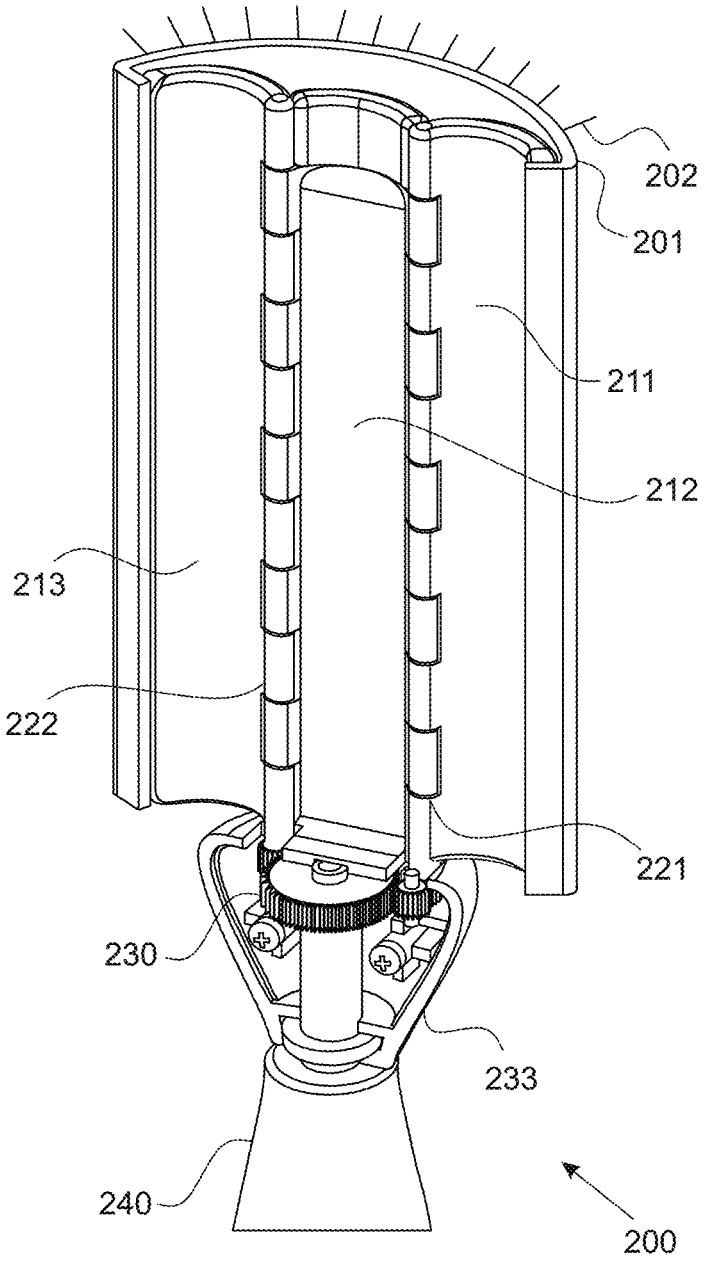
FIG. 2A is an illustration of a partial view of the tri-position hairbrush, in accordance with some demonstrative embodiments.

Reference is made to FIG. 2A, which is a partial view of a tri-position hairbrush 200, in accordance with some demonstrative embodiments. The view shown is a cross-sectional view or an exploded view, which shows external components and/or internal components of hairbrush 200.

Hairbrush 200 comprises a handle 240 which may be held by the user, connected through a base-region 233 to a bristle-bed 201. In the particular view shown in FIG. 2A, the hairbrush 200 and the bristle-bed 201 are in a curved position or semi-open position. The handle 240 may be formed of plastic, wood, metal, and/or other suitable rigid material(s).

The bristle-bed 201 comprises or has numerous distinct bristles 202, each bristle 202 extending radially away from (or outwardly relative to) the bristle-bed 201; for example, each bristle 202 being perpendicular or generally-perpendicular relative to the bristle-bed region in which the bristle 201 is rooted or is based. The bristles 202 may be formed of natural material(s), animal-based materials (e.g., hair of a pig or boar or wild boar), synthetic or man-made materials, nylon, polyester, plastic, and/or other suitable types of filaments or wires. In some embodiments, all the bristles 202 may have the same degree of flexibility or rigidity or elasticity; or, in other embodiments, a first set or group of bristles 202 may have a first degree or level of flexibility or rigidity or elasticity, while a second set or group of bristles may have a second, different, degree or level of flexibility or rigidity or elasticity; for example, in order to provide a variety of hair treatment methods to the user of the hairbrush. Optionally, bristle-bed 201 may be padded or coated, or may comprise a soft or sponge-like layer, such that the root or base of each bristle 202 may connect to a soft external layer of the bristle-bed.

The bristle-bed 201 is a non-monolithic structure, or is constructed as having multiple discrete yet inter-connected panels or regions. In a demonstrative embodiment, bristle-bed 201 is comprised of three elongated panels 211-213; wherein the first panel 211 is connected to the second panel 212 via a first set of hinges 221, and wherein the second panel 212 is interconnected to the third panel 213 via a second set of hinges 222.

The third panel 213 is not connected to the first panel 211, thereby enabling the entire structure of the bristle-bed 202 to have a certain degree of freedom that allows the three panels 211-213 (or, the multiple panels, if another number of panels is utilized) to rotate or to move relative to each other, or to modify the slanting or the angle between two neighboring panels or two neighboring regions of the bristle-bed 201; thereby modifying the level of openness or closure of the entire structure of the bristle-bed 201.

In a demonstrative embodiment, the bristle-bed 201 comprises N elongated panels (e.g., N=3 in the depicted example). Each such bristle-bed panel is an elongated and slightly-curved panel, which covers an arc of approximately 360/N degrees. For example, in a tri-panel or triple-panel embodiment, each one of the three elongated panels covers an arc of approximately 120 degrees; and two elongated lines (or sets) of hinges are utilized to interconnect the three panels and to enable their selective, modular, spatial movement and re-positioning. The number of hinges, or the number of sets of hinges, that are used for N panels is N−1, since each two neighboring panels are inter-connected via a single hinge or by a set of hinges; and since the 1st panel and the Nth panel are not connected to each other via any hinge.

Alternatively, in a quad-panel or quadruple-panel embodiment, each one of four elongated panels covers an arc of approximately 90 degrees; and three elongated lines of hinges are utilized to interconnect the four panels and to enable their selective, modular, movement and re-positioning.

Alternatively, in a five-panel or penta-panel embodiment, each one of five elongated panels covers an arc of approximately 72 degrees; and four elongated lines of hinges are utilized to interconnect the five panels and to enable their selective, modular, movement and re-positioning.

Alternatively, in a six-panel or hexa-panel embodiment, each one of six elongated panels covers an arc of approximately 60 degrees; and five elongated lines of hinges are utilized to interconnect the six panels and to enable their selective, modular, movement and re-positioning.

In some embodiments, two or more of the panels or the bristle-bed need not necessarily have the same size or shape, and/or need not necessarily cover the same spatial arc of degrees; for example, some embodiments may utilize four panels, in which a first (e.g., wider) panel covers 120 degrees, a second (e.g., narrower) panel covers 60 degrees, a third (e.g., wider) panel covers 120 degrees, and a fourth (e.g., narrower) panel covers 60 degrees. Other suitable number of panels and/or degrees of coverage may be utilized.

The movement or the relative movement of the panels 211-213, may be performed or enabled or controlled or regulated via a switch or actuator, such as gear mechanism 230, which may be utilized to rotate or spin or move the panels 211-213 (or some of them, or one of them), and/or in order to lock the panels 211-213 in place in order to maintain a particular position, and/or in order to unlock the panels 211-213 from being non-movable to become movable and to assume a different spatial structure. In some embodiments, optionally, the base-region 233 may comprise multiple components or units; for example, a first component (e.g., gear mechanism) to enable movement or rotation of the panels, and a second component (e.g., a locking/unlocking mechanism) to lock-in-place the multiple panels and/or to release the multiple panels for rotation or re-positioning. In some embodiments, optionally, two User Interface (UI) elements may be included; for example, a first UI element such as a rotating gear for the rotation operation, and a second UI element such as a sliding pin or a locking unit or a locking-and-unlocking unit which locks-in-place the panels or releases them for further movement (or, which locks-in-place the rotating gear, or releases it; and which may similarly be operated to unlock or release a previous locking position).

In some embodiments, these mechanism(s) may enable the user to selectively switch between three discrete and pre-defined states or modes of operations or positions of the hairbrush. In other embodiments, the mechanism(s) may enable the user to switch in a generally continuous manner between various degrees of openness or closure of the bristle-bed, and to lock-in-place the elongated panels once the user reaches a particular degree of spatial coverage to his satisfaction. For example, in some embodiments, such mechanisms need not necessarily switch among 3 (or, among N) particular discrete positions or operational modes; but rather, may enable to gradually modify the level of curvature or the degree of opening of the bristle-bed, from a fully-closed mode (e.g., in which the bristle-bed spans 360 degrees, or almost 360 degrees, or at least 350 degrees), through numerous interim operational modes, to a fully-open operational mode (e.g., in which the bristle-bed covers approximately 180 degrees or curvature, or approximately 120 or 150 degrees of curvature).

Figure 2B:
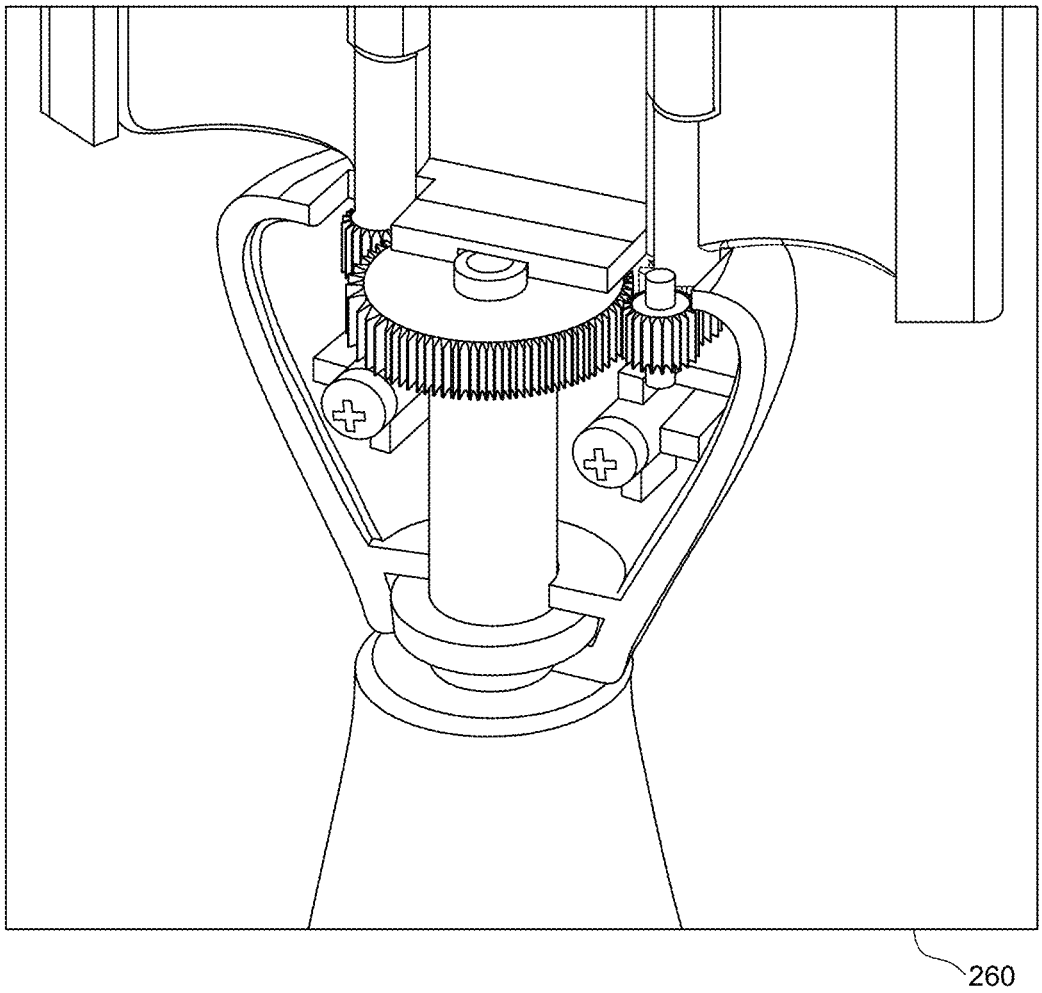
FIG. 2B is an illustration of an enlarged or zoomed-in portion of the tri-position hairbrush, showing in greater details the actuation or switching mechanism, in accordance with some demonstrative embodiments.

Reference is made to FIG. 2B, which is an illustration of an enlarged or zoomed-in portion 260 of hairbrush 200, showing in greater details the actuation or switching mechanism, in accordance with some demonstrative embodiments. For example, a main gear or a central gear is directly actuated or operated by the user; and this gear may cause, for example, rotational movement of secondary gears, such that each secondary gear causes rotational movement of one panel or of two panels that are connected to a hinge (or, to a set of hinges) that are located above such secondary gear.

In some embodiments, bristles are connected directly to (or, are rooted or based directly at) the N elongated panels that are able to move or rotate about their hinges. In other embodiments, optionally, the bristles are not connected directly to (or, are not rooted or based directly at) those N elongated panels; but rather, such bristles may be connected to (or, may be rooted or based at) an additional layer that is, in turn, connected to the N elongated panels or that otherwise surrounds or encircles or touches those N elongated panels from their external side; for example, having a sponge or sponge-like layer, or a cushioning layer, that is connected or glued to the elongated panels, and having the bristles be rooted or based in that additional layer; and such interim layer may ensure that the user's head need not touch the elongated panels directly, as they may be formed of a rigid material (e.g., metal, wood, rigid plastic), but rather, the user's head may occasionally touch the interim layer or the sponge layer or the cushioning layer (e.g., optionally formed of soft or non-rigid plastic material). In some embodiments, optionally, the area of such cushioning layer that is external to the N elongated panels, may be greater than the combined area of the N elongated panels; for example, in order to enable such cushioning layer to slightly expand itself as the N panel are re-arranged from a fully-open position to a fully-closed position; or to otherwise facilitate the efficient operation of the tri-position hairbrush and/or the efficient transition or switching among operational modes of the tri-position hairbrush.

Figure 2C:
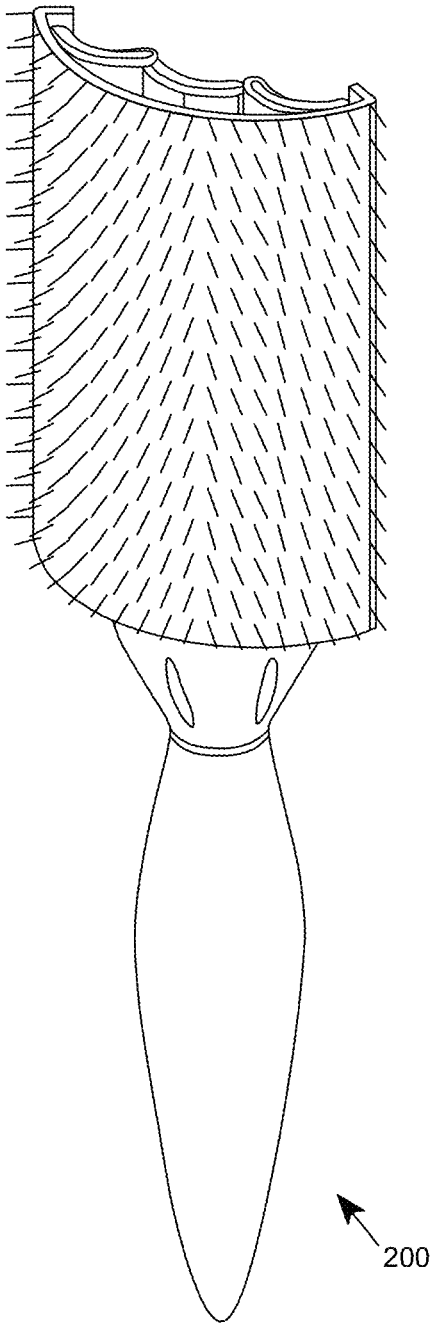
FIG. 2C is an illustration of a view of the tri-position hairbrush from an opposite direction relative, in accordance with some demonstrative embodiments.

Reference is made to FIG. 2C, which is a view of hairbrush 200 from an opposite direction relative to the direction shown in FIG. 2A, in accordance with some demonstrative embodiments.

Figure 2D:
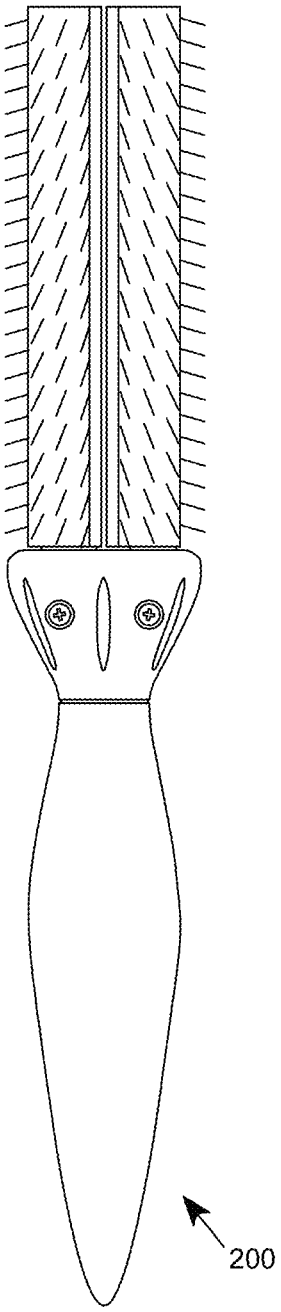
FIG. 2D is an illustration of the tri-position hairbrush in a round position or in a closed operational state, in accordance with some demonstrative embodiments.
Figure 3A:
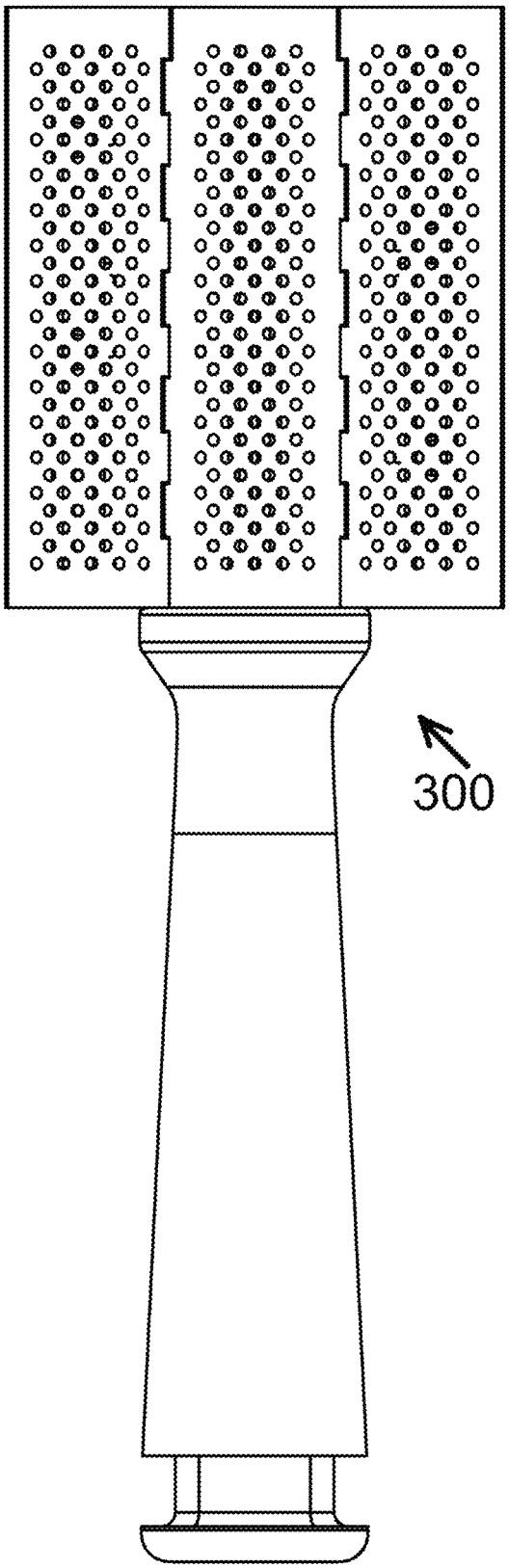
FIGS. 3A-3G are schematic illustrations of several views of a modular hairbrush, in its fully-open position, in accordance with some demonstrative embodiments.
Figure 3B:
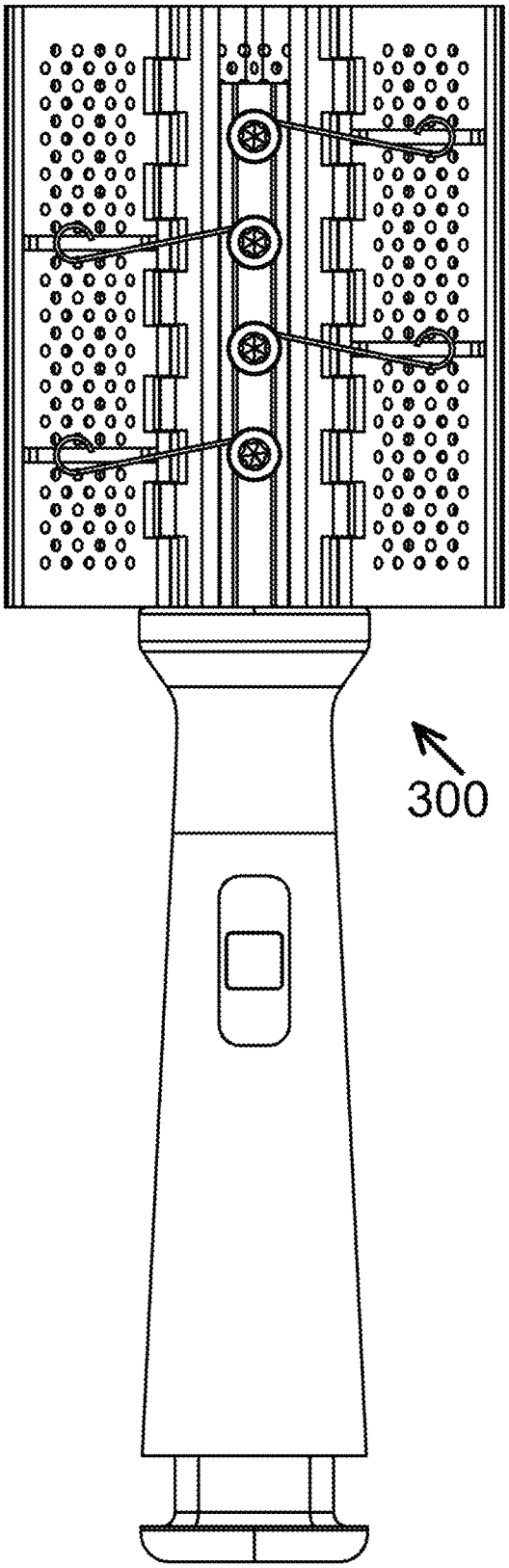
Figure 3C:
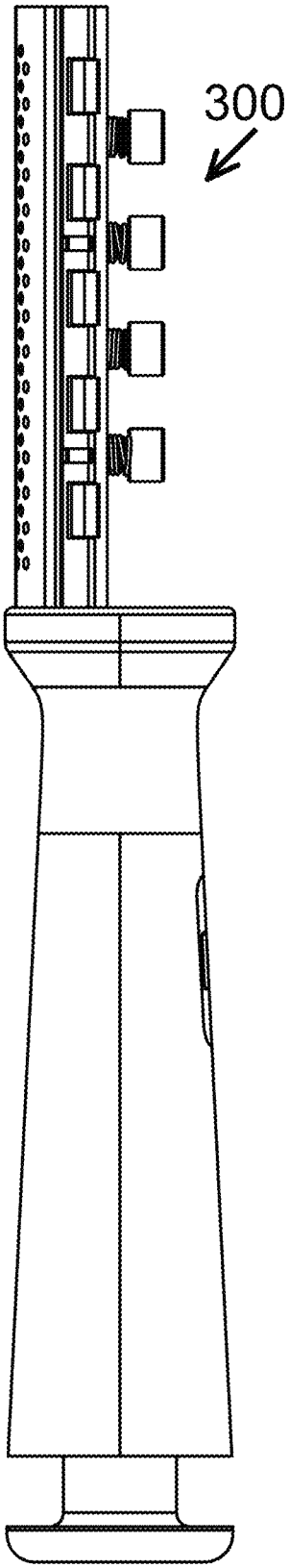
Figure 3D:
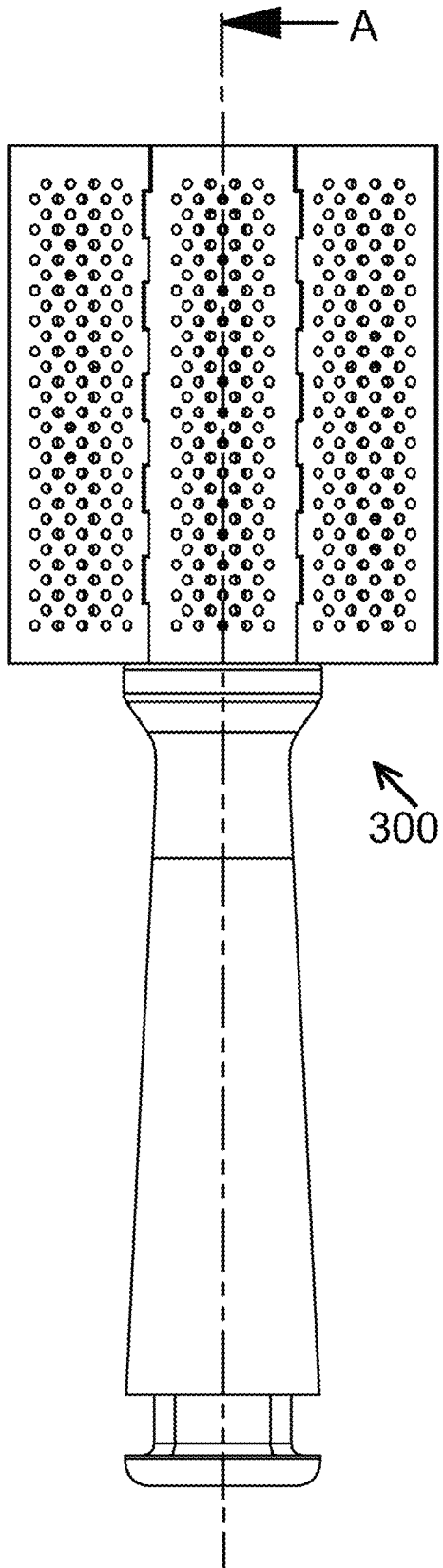
Figure 3E:
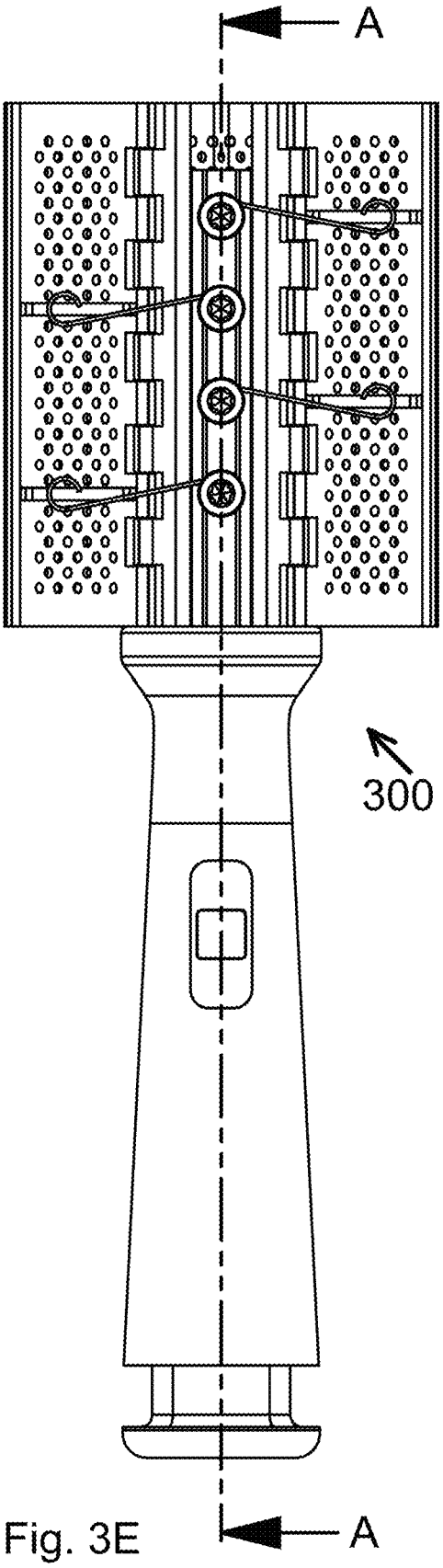
Figure 3F:
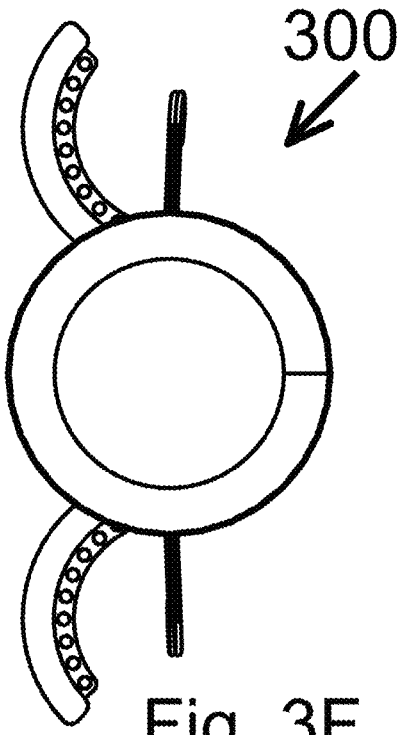
Figure 3G:
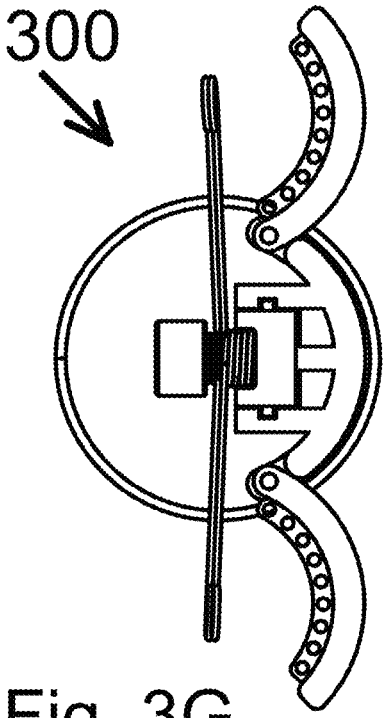
Figure 4A:
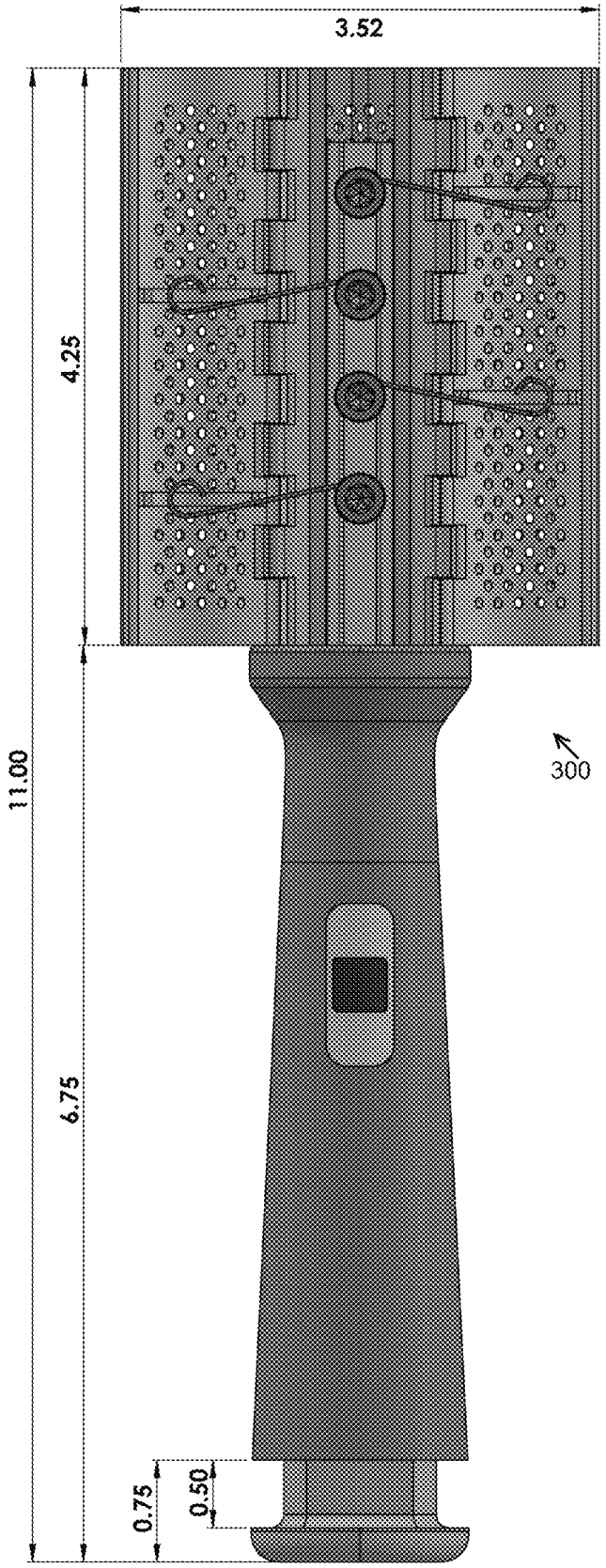
FIGS. 4A-4H are schematic illustrations of several additional views of the modular hairbrush, in its fully-open position, in accordance with some demonstrative embodiments.
Figure 4B:
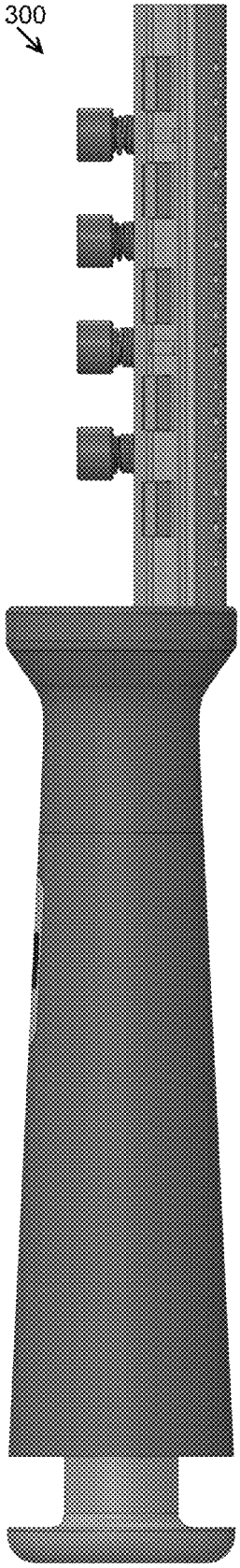
Figure 4C:
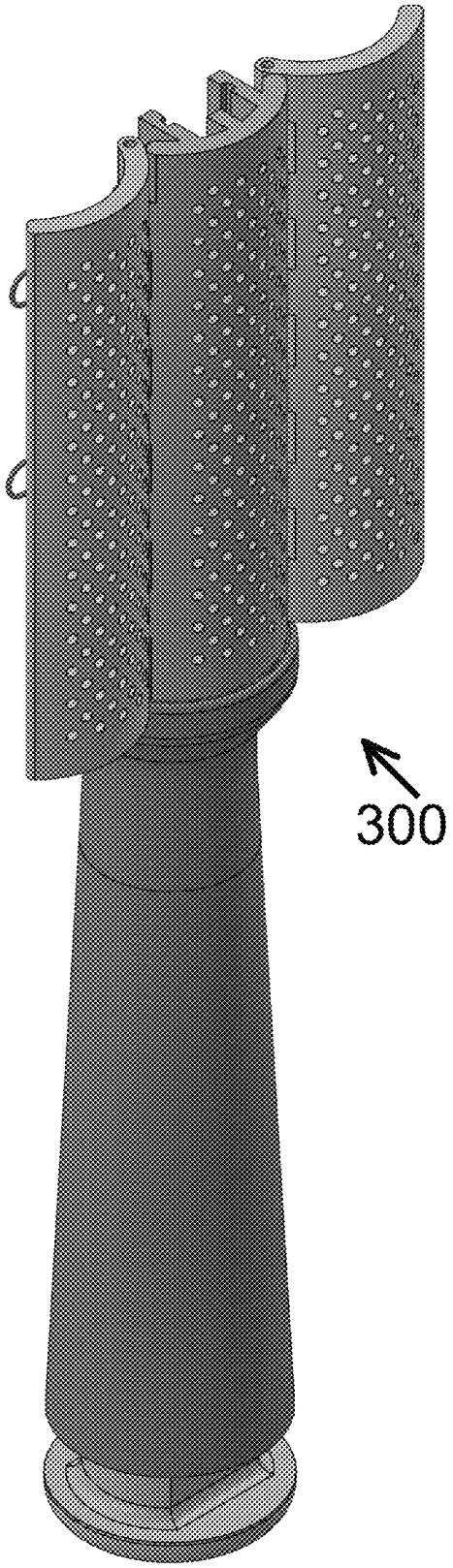
Figure 4D:
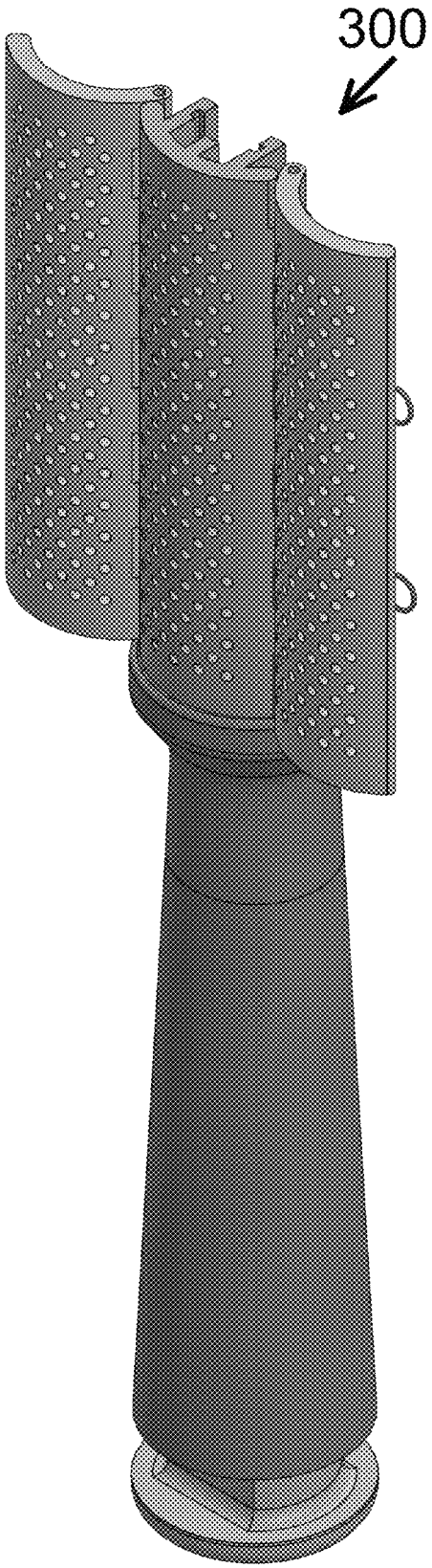
Figure 4E:
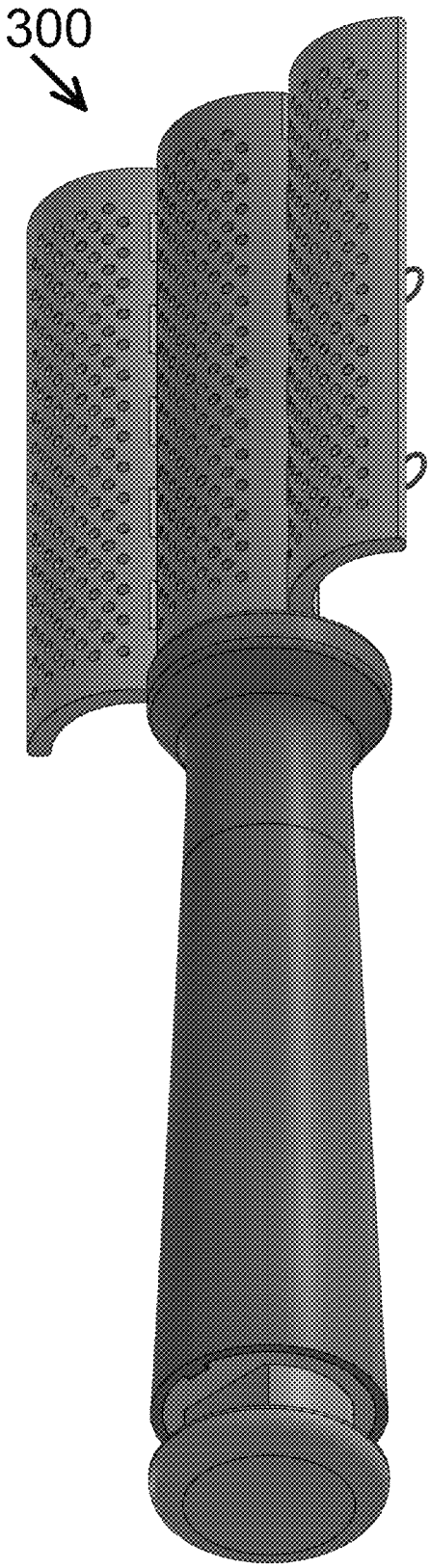
Figure 4F:
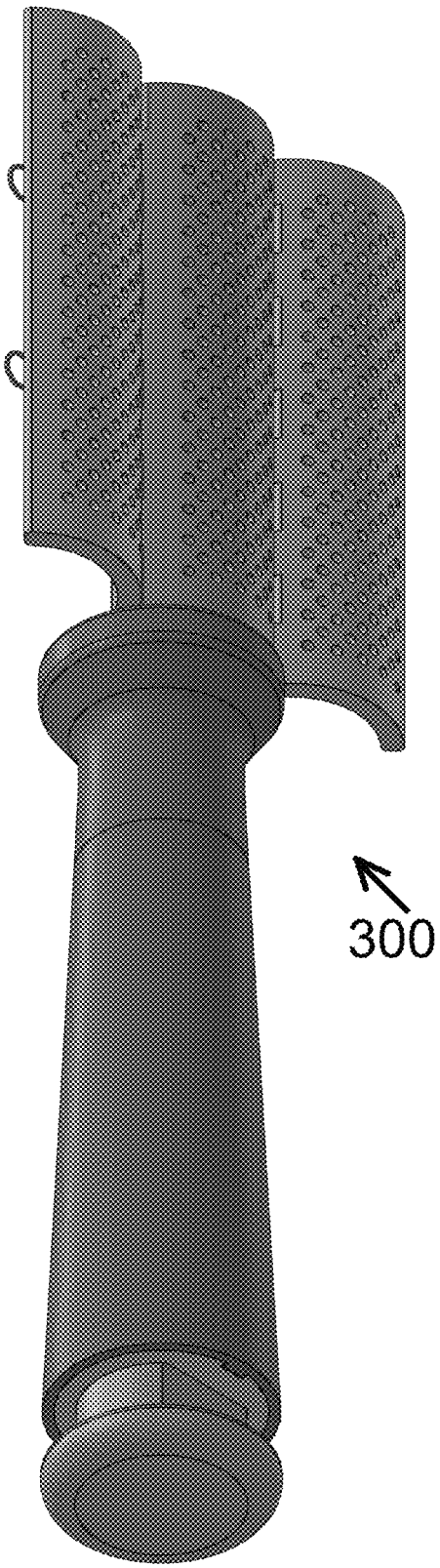
Figure 4G:
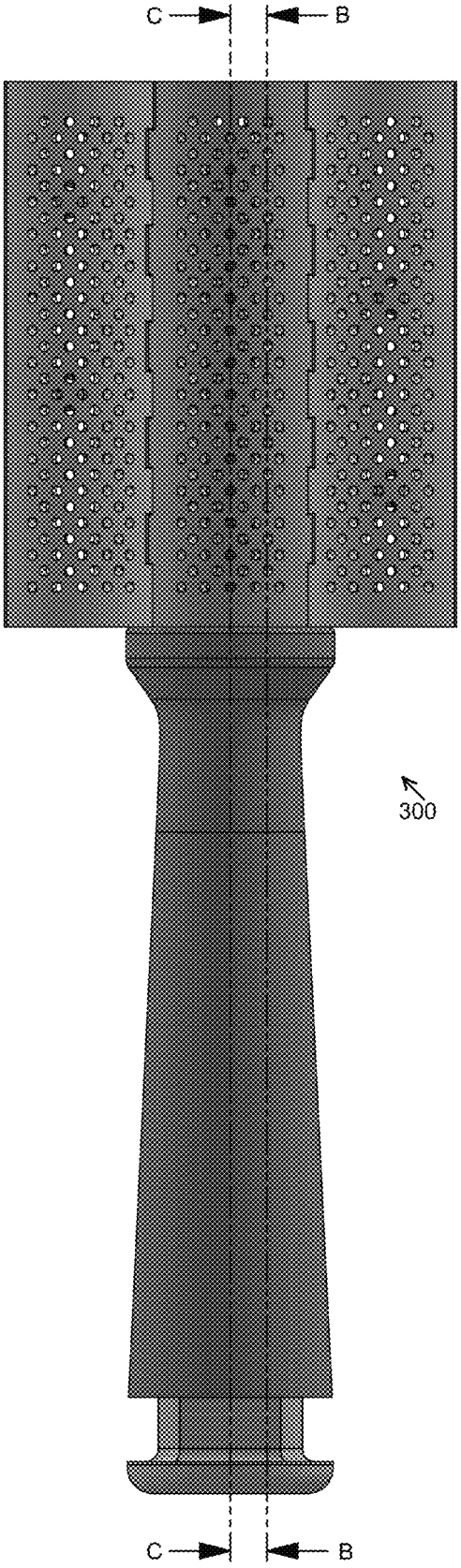
Figure 4H:
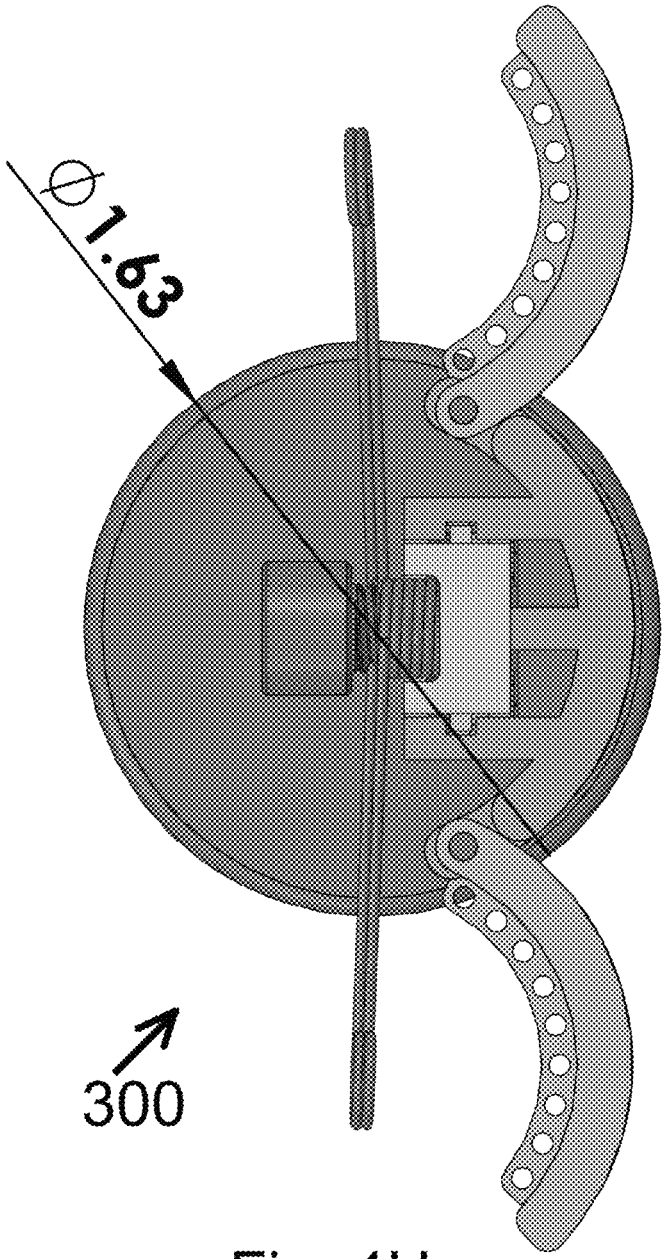

Reference is made to FIG. 2D, which is an illustration of hairbrush 200 in a round position or in a closed state, in accordance with some demonstrative embodiments.

Some embodiments may solve or mitigate the problem of owning, utilizing and/or maintaining multiple different kinds of hairbrushes, which may crowd the user's table or drawer or purse or pocket(s). Some embodiments may solve or mitigate the problem of having to lug around or carry multiple, bulky, hairbrushes when the user travels or needs to transport his belongings from one venue to another venue. Some embodiments may solve or mitigate the problem of having to purchase multiple different hairbrushes in order to create different hair styles and/or in order to achieve multiple different hair-styling goals.

Some embodiments include a single, multiple-position, hairbrush that can be transformed or switched or modified among multiple modes, which may include: (I) a small form-factor, cylindrical shaped hairbrush or "Round Hairbrush" for achieving tight to loose curls, as well as bouncy styles of hair; and (II) a medium, curved, semi-round or "Curved Hairbrush", such as for creating moderate lift at the roots, soft lines, and a gentle bend at the ends; and (III) a flat Paddle Brush for various uses such as for basic de-tangling and smoothing or for achieving very straight hairstyles.

The modular hairbrush of some embodiments, and particularly its bristle-bed, is able to shape-shift in response to the user's actuation, from being cylindrical (round) to being curved (e.g., half a cylinder) to being flat or almost flat or being paddle-shaped; via a spatial modification mechanism or a spatial re-arrangement mechanism, optionally utilizing a set of gears and hinges and a locking/unlocking mechanism (e.g., implemented via a stopping pin, or via a ratchet and pawl mechanism). The bristle-bed of the hairbrush may transform from being rounded to being curved to being completely flat, for greater flexibility in the hairstyles that it allows the user to create.

In a demonstrative implementation, the module hairbrush selectively "opens" and "closes" to three different settings, which put the hairbrush into three different positions or structures or shapes or configurations, respectively. Each of the three shapes or configurations is suitable for performing a particular, different, hairstyling task or goal. Each of the three shapes or configurations is suitable for creating a different hairstyle. Each of the three shapes or configurations is best suitable for achieving a different result. The modular hairbrush of some embodiments eliminates the need to purchase, use, store, clean, transport and/or carry three different hairbrushes for achieving three different hairstyling objectives.

In a demonstrative embodiment, a set of gears turns multiple hinges in order to open and/or close the hairbrush's bed of bristles (which is comprised of multiple elongated panels), thereby switching the hairbrush among three shape settings: cylindrical, open curved, and flat. The gears are located between the base of the bristle-bed (the brush head) and the handle, and/or at the top of the handle where the handle meets the bristle-bed (the brush head). The gears are structured to be activated manually, easily, and quickly with the simple click of a single finger on a grooved, dial-like wheel. The grooves on the wheel create the traction or friction required for a finger of the user to move or rotate the wheel and thus change the gear rotational position.

Once the desired position is in place, a locking mechanism keeps or maintains it firmly in place. The locking mechanism control switch may be located adjacent to the gear control wheel. When the controls (or the elongated panels) are in a locked position, they physically press on the gear, as a vice, to hold it in place.

The hinges that open and close to control the shape of the brush are arranged in a single, straight line running the entire length of the bristle-bed (the brush head); one line of hinges connecting between two neighboring elongated panels of the bristle-bed. When the brush is fully closed into a cylindrical barrel, the hinges are closed inside the barrel, such that all the hinges are internal and are not seen by the user. When the brush is in its semi-open, curved shape or in its fully flat shape, the hinges may be seen along the external side of the brush (e.g., the side that is external but is opposite to the bristle side of the hairbrush). Optionally, the hinges are recessed, or sunken, relative to (or into) the surface of the panels or of the bristle-bed, so as not to protrude from the hairbrush's flat surface and to avoid the hinges from catching stray hairs.

Gears, hinges, locks, and/or other components of the hairbrush may be formed of stainless steel that will not rust (e.g., over time, and/or due to contact with liquids, water spray, hair spray, mousse, shampoo, conditioner, or other styling products commonly used to achieve volume, hold, texture, shine, or other properties).

In a demonstrative embodiment, the modular hairbrush can be transformed by the user among three different settings. The first setting locks the hairbrush into a cylindrical ("round brush") shape, which is used to tame frizz, to deliver bounce and volume (especially at the roots), and/or to create rounded contours in hair strands ranging from gentle bends and waves to curls (and optionally, the modular hairbrush may be transported and/or sold while being in the first setting, which has the smallest form-factor). The second setting locks the hairbrush into an open-curve shape, forming an arc (e.g., of approximately 150 or 180 or 210 or 240 degrees); such open-curved shape allows the user to create hairstyles characterized by soft, gently curved, natural-looking lines (e.g., as opposed to more defined waves or curls). The third setting locks the brush into a flat ("paddle brush") shape, which is utilized to achieve straight hairstyles, for basic blow-drying without a distinctive style, and/or for smoothing and/or detangling dry hair.

Some embodiments further comprise a method of using or operating a modular hairbrush or a multiple-positions hairbrush; for example, having the following steps or some of them: (i) unlocking the hairbrush while it is in a first position; (ii) modifying the structure of the hairbrush into a second position; (iii) locking the hairbrush in its second position. These steps may utilize suitable operations of engaging or actuating, pushing, pulling, sliding, moving, locking, unlocking, rotating a gear, spinning a gear, moving a lever, pushing a button, sliding a pin, and/or other suitable operations. Some embodiments further comprise a system for manufacturing such modular hairbrush; for example, by using and operating means, include automatic or semi-automatic means, for performing the steps of the manufacturing method described above or herein.

Some embodiments further comprise a method of manufacturing or producing a modular multiple-position hairbrush; for example, having the following steps or some of them: (i) producing or providing or obtaining multiple elongated panels of a bristle-bed; (ii) interconnecting some of said elongate panels, but not all of said panels, via inter-connecting hinges that enable at least a first panel to rotate or swivel relative to a second, neighboring, panel; (iii) producing or providing or connecting a switching mechanism, such as a gear mechanism, that enables a user to rotate a gear which in turn rotates or spins or swivels one or some or all of the elongated panels; (iv) producing or providing or connecting a lock/unlock mechanism, which is operable to lock the gear in place and/or to lock the elongated panels in place, and/or is operable to release or unlock a previously-locked gear or panel(s).

In some embodiments, the transition among positions or structures is performed via an entirely-manual operation, such as via the rotating gear and the lock/unlock mechanism. In other embodiments, optionally, an electric mechanism may be utilized, such that a miniature or small-size electric motor is triggered by a user interface, and the motor causes a pulling or pushing of the elongated panels and/or causes the rotation of the gear(s) to achieve the modification of the spatial structure of the hairbrush. Optionally, such electric mechanism and/or motor may be powered by a battery or a rechargeable battery, which may be stored (for example) within or inside the handle of the hairbrush and/or within the base-region of the hairbrush. In some embodiments, such rechargeable battery may be recharged via a cable or wire (e.g., a mini-USB or micro-USB connector or port); or may be charge wirelessly via a wireless battery-charging mechanism; for example, similar to the manner in which an internal battery of a smartphone is charged via a wire or wirelessly.

FIGS. 3A-3G are schematic illustration of several views of a modular hairbrush 300, in its fully-open position, in accordance with some demonstrative embodiments. The numerous bristles (e.g., dozens of bristles) of such hairbrush are not shown, in order to not obscure the details of the other mechanical parts that are shown.

FIGS. 4A-4G are schematic illustration of several additional views of the modular hairbrush 300, in its fully-open position, in accordance with some demonstrative embodiments. The numerous bristles (e.g., dozens of bristles) of such hairbrush are not shown, in order to not obscure the details of the other mechanical parts that are shown.

Figure 5A:
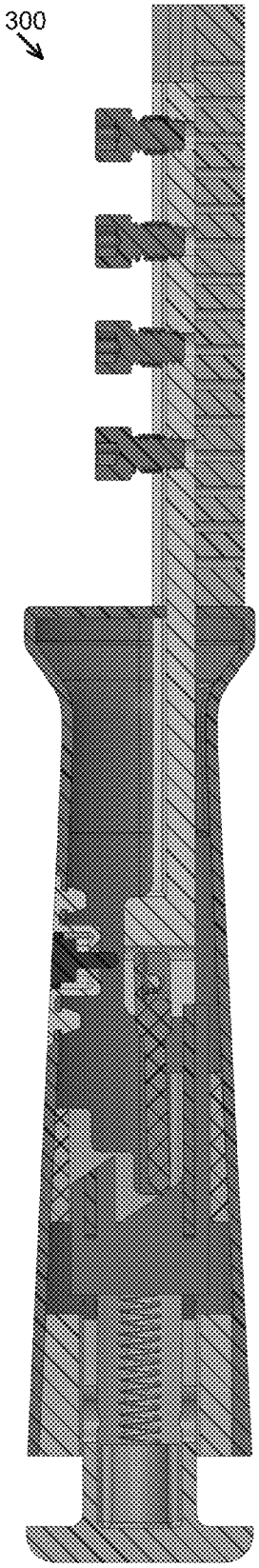
FIGS. 5A-5C are schematic illustrations of several cross-sectional views of the modular hairbrush, in its fully-open position, in accordance with some demonstrative embodiments.
Figure 5B:
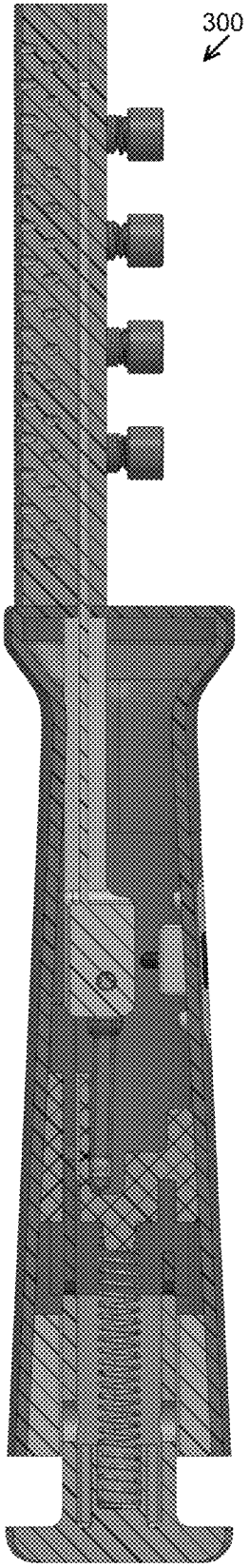
Figure 5C:
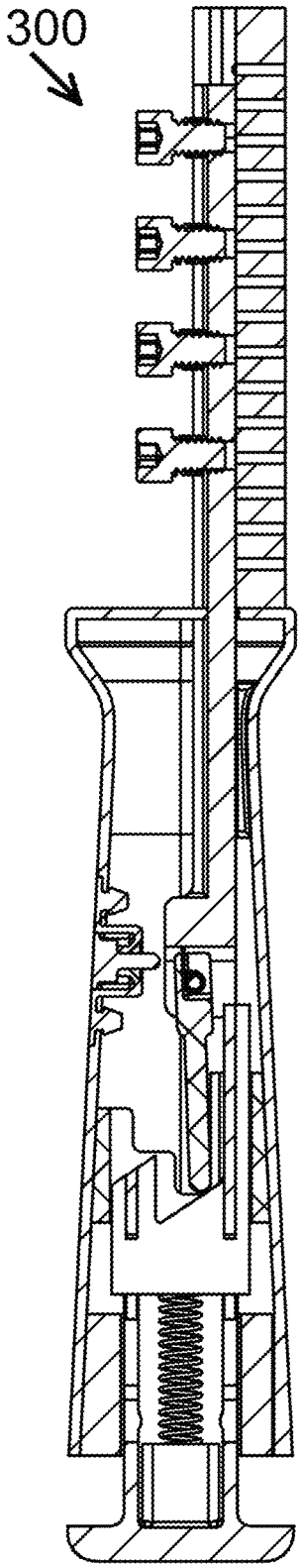
Figure 6A:
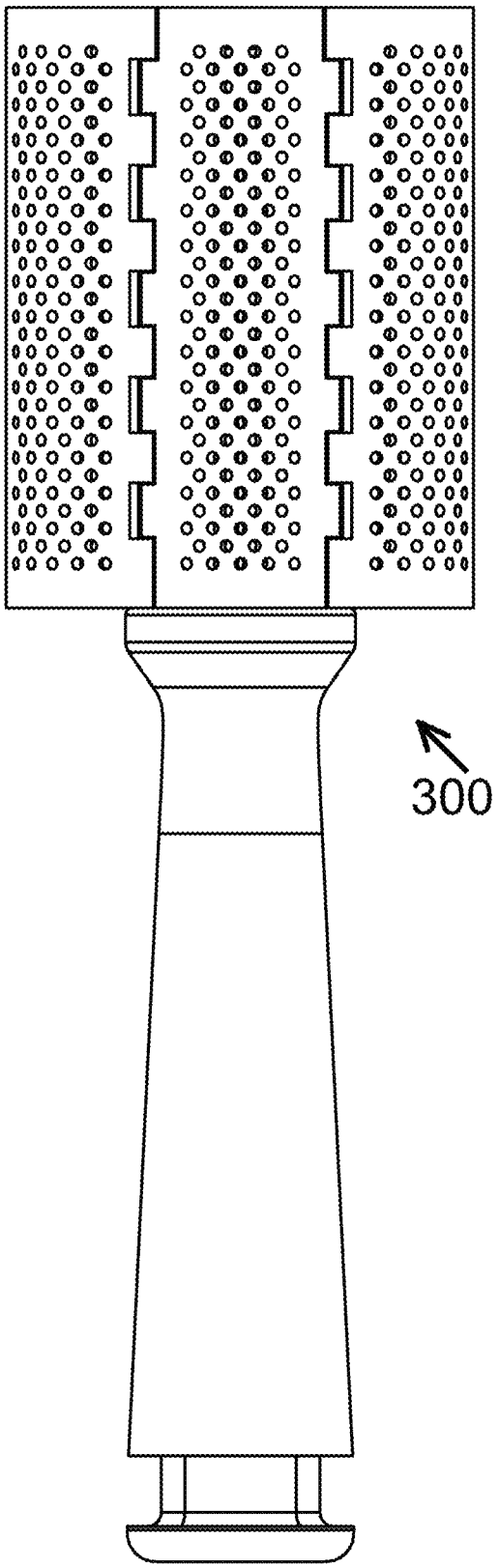
FIGS. 6A-6G are schematic illustrations of several views of the modular hairbrush, in its semi-open position, in accordance with some demonstrative embodiments.
Figure 6B:
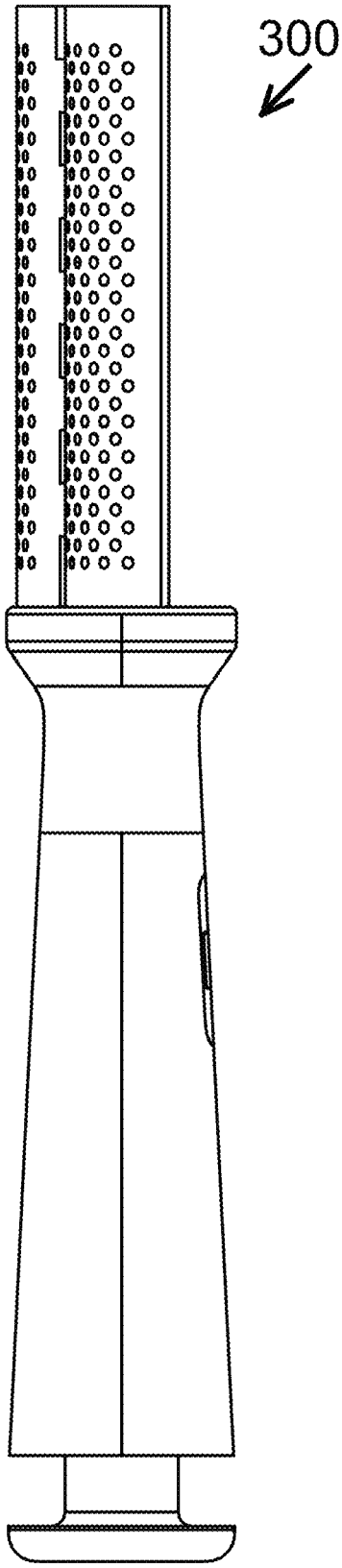
Figure 6C:
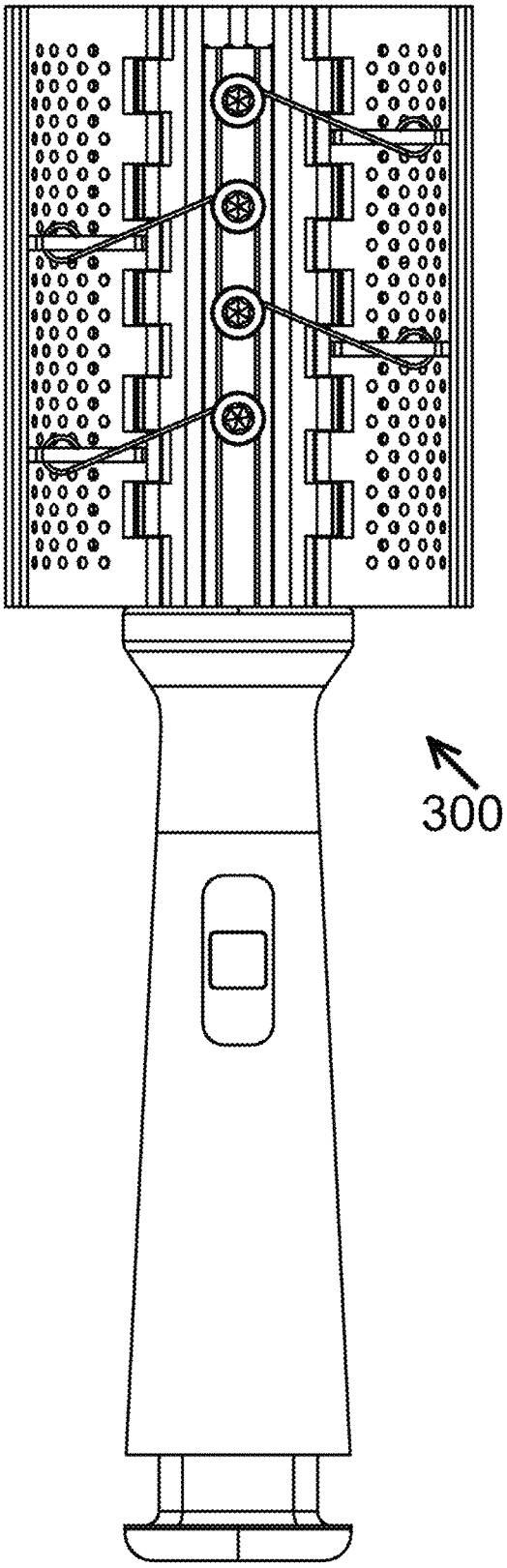
Figure 6D:
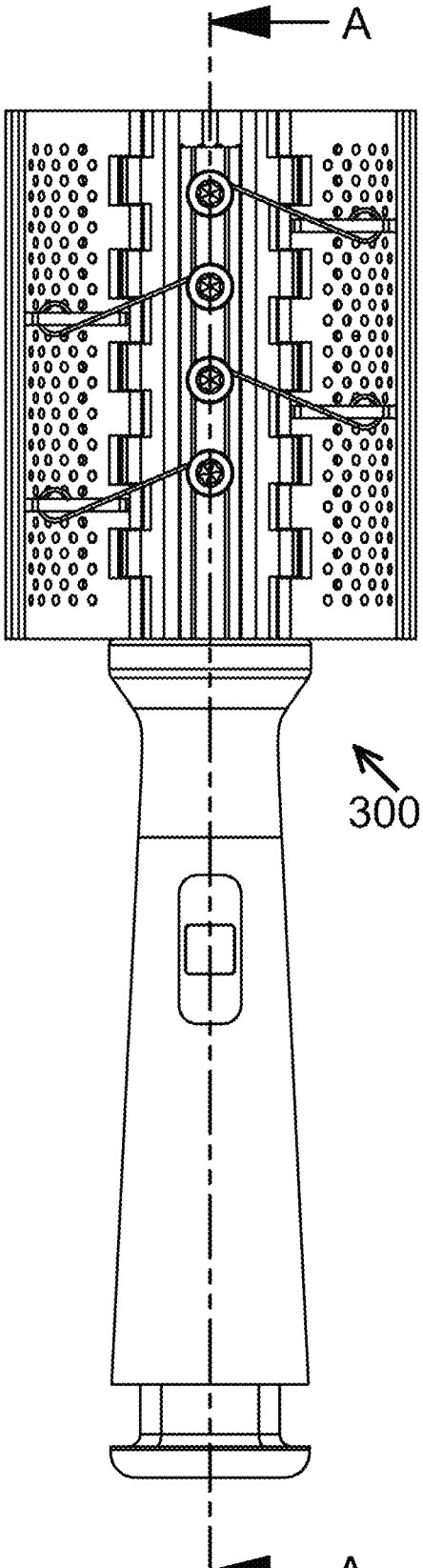
Figure 6E:
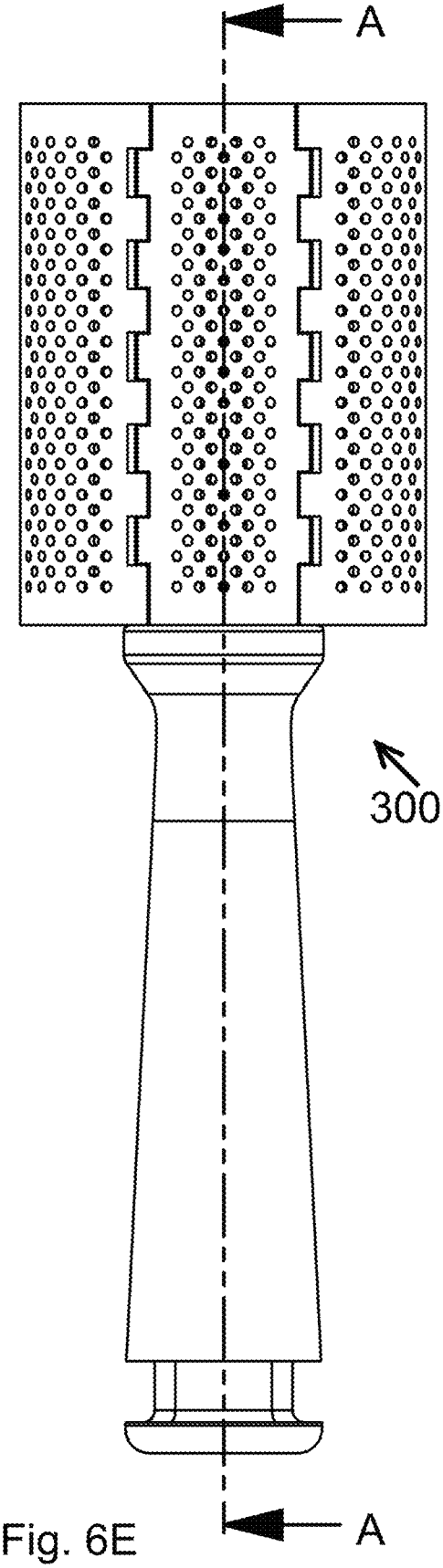
Figure 6F:
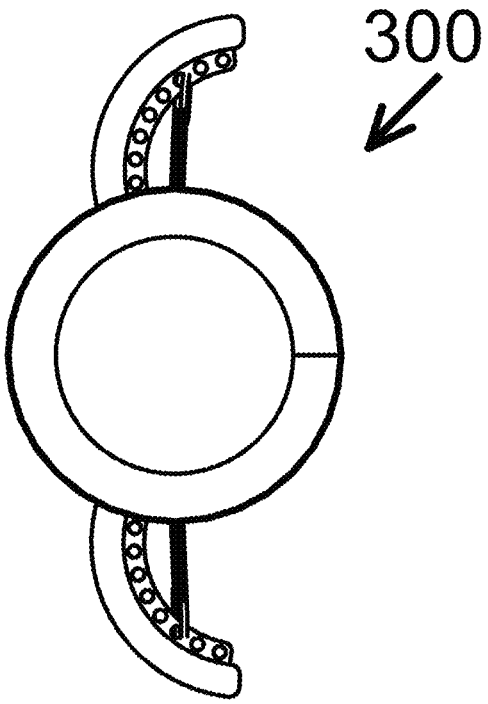
Figure 6G:
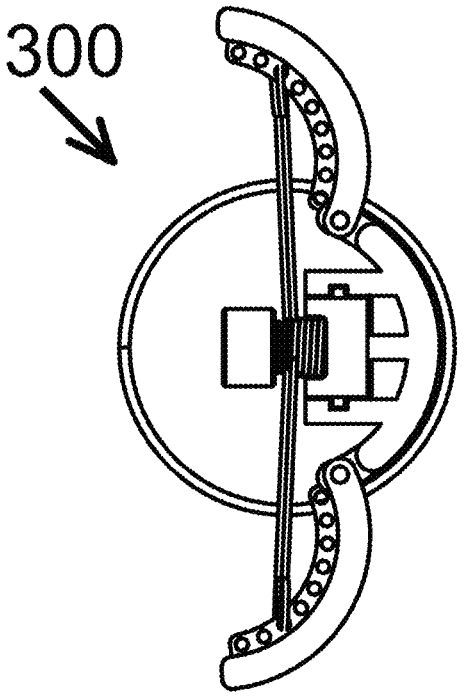

FIGS. 5A-5C are schematic illustration of several cross-sectional views of the modular hairbrush 300, in its fully-open position, in accordance with some demonstrative embodiments. The numerous bristles (e.g., dozens of bristles) of such hairbrush are not shown, in order to not obscure the details of the other mechanical parts that are shown.

FIGS. 6A-6G are schematic illustrations of several views of the modular hairbrush 300, in its semi-open position, in accordance with some demonstrative embodiments. The numerous bristles (e.g., dozens of bristles) of such hairbrush are not shown, in order to not obscure the details of the other mechanical parts that are shown.

Figure 7A:
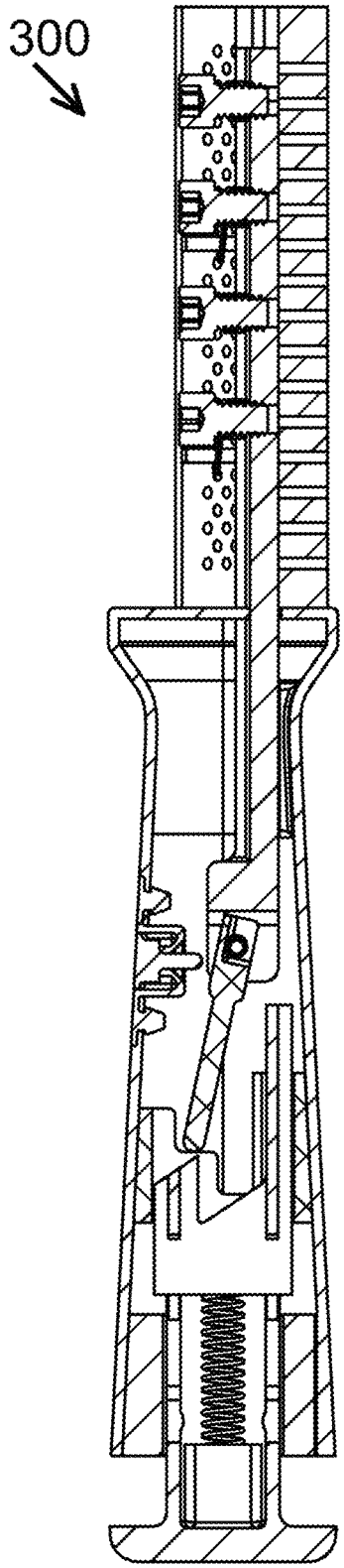
FIGS. 7A-7B are schematic illustrations of several cross-sectional views of the modular hairbrush, in its semi-open position, in accordance with some demonstrative embodiments.
Figure 7B:
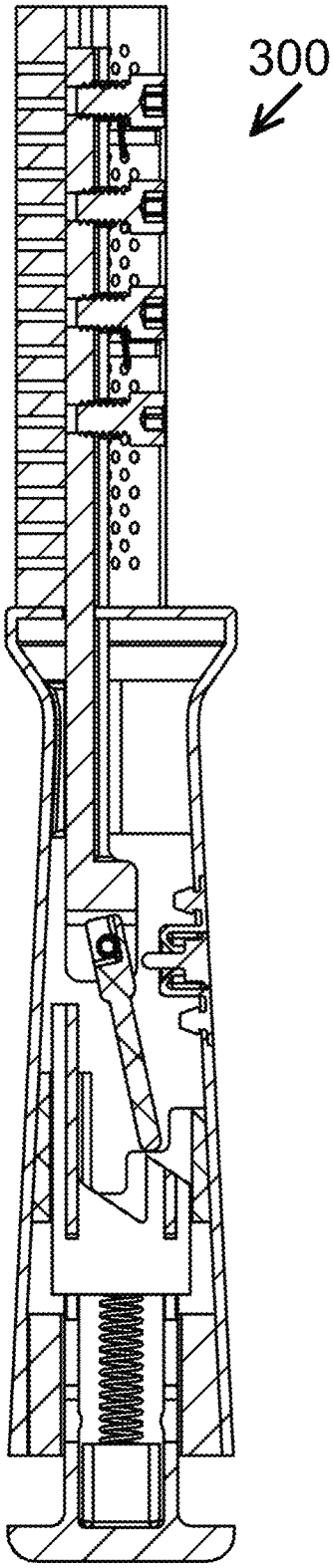
Figure 8A:
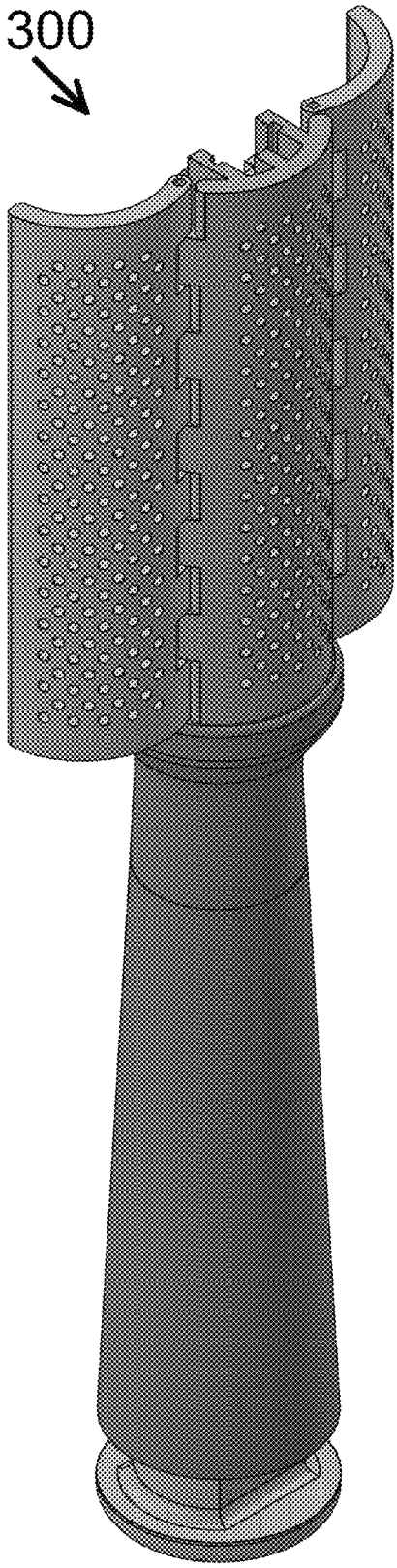
FIGS. 8A-8H are schematic illustrations of several views of the modular hairbrush, in its semi-open position, in accordance with some demonstrative embodiments.
Figure 8B:
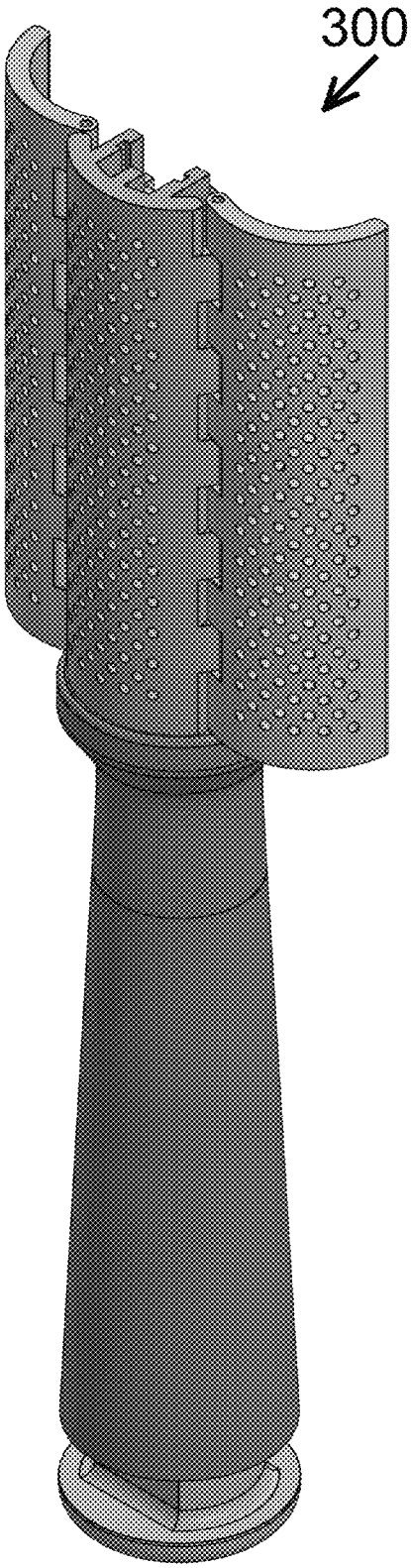
Figure 8C:
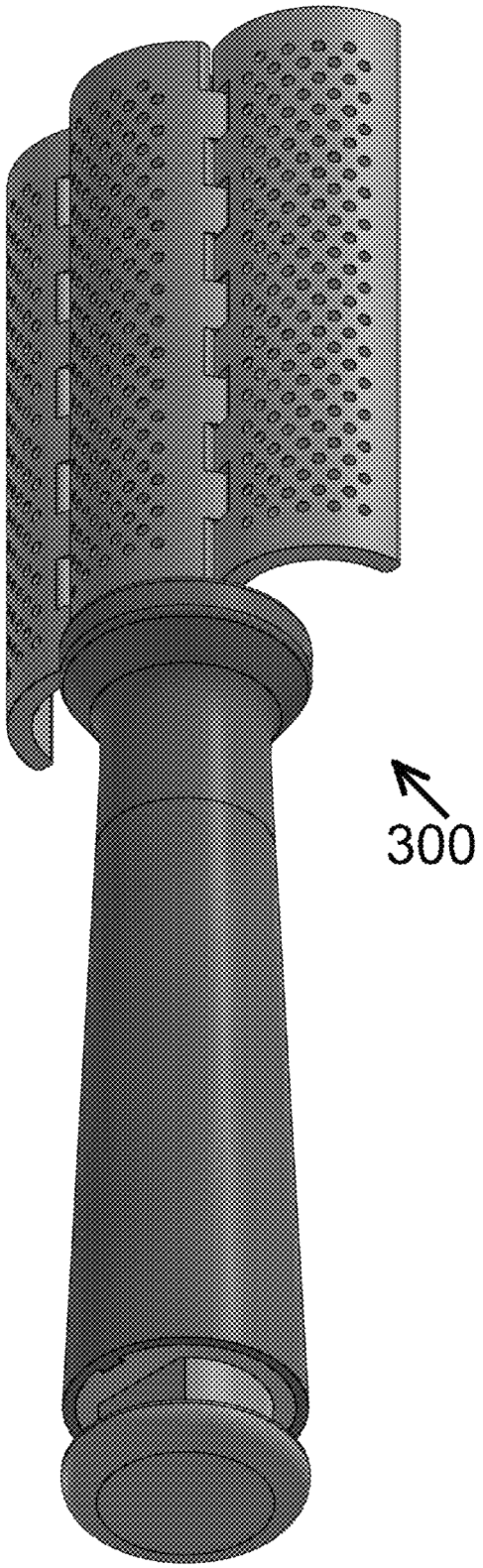
Figure 8D:
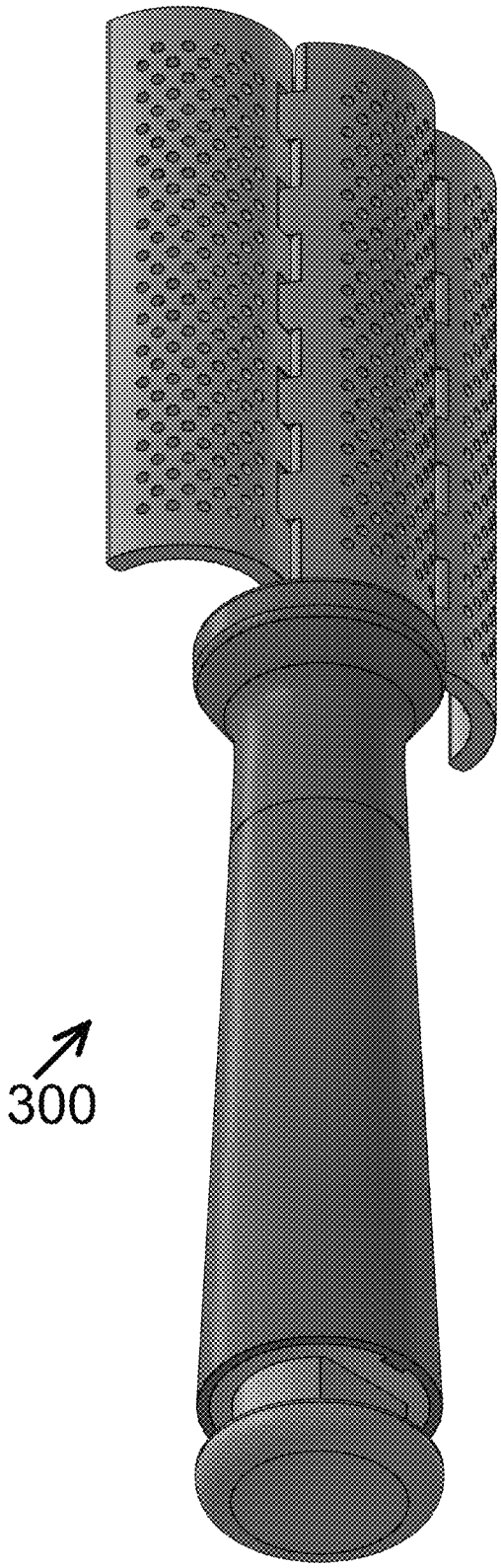
Figure 8E:
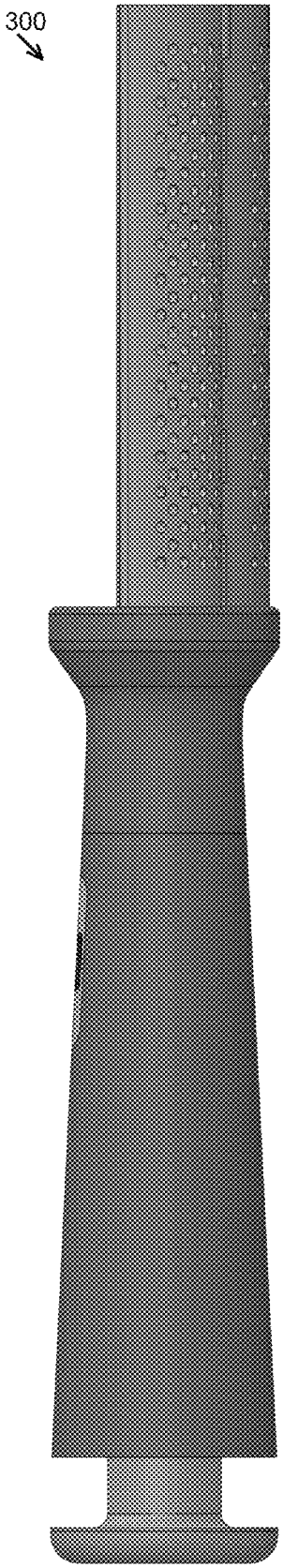
Figure 8F:
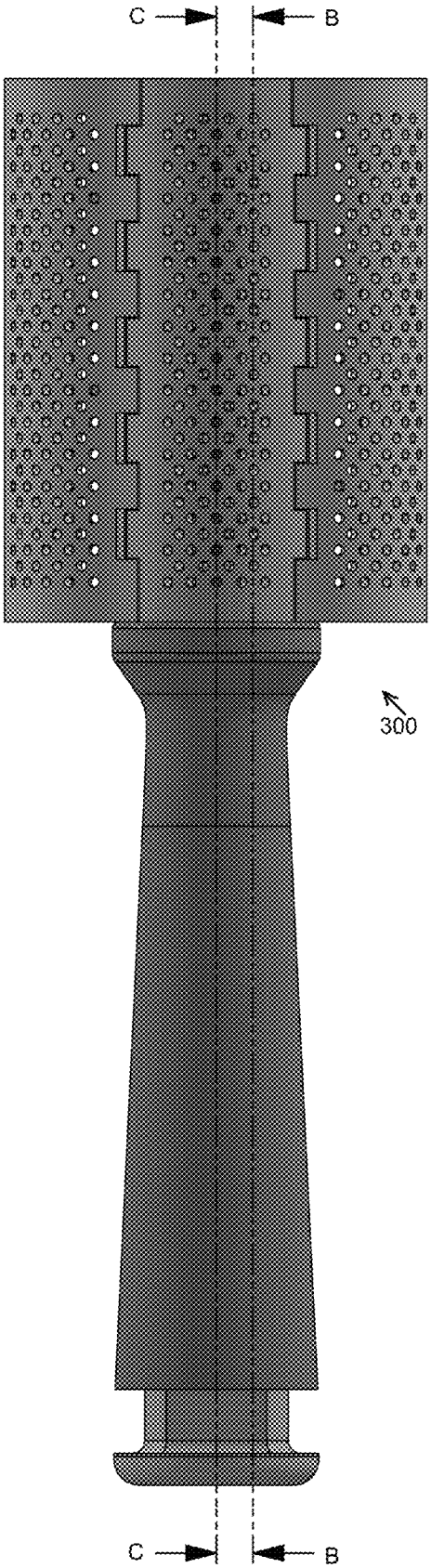
Figure 8G:
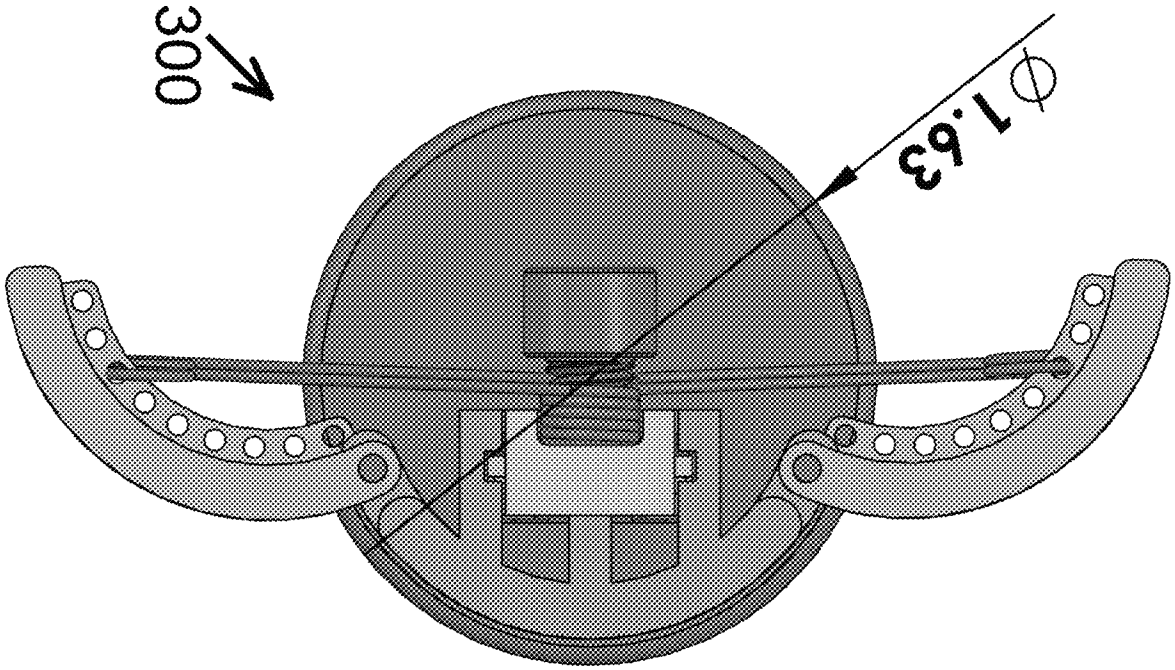
Figure 8H:
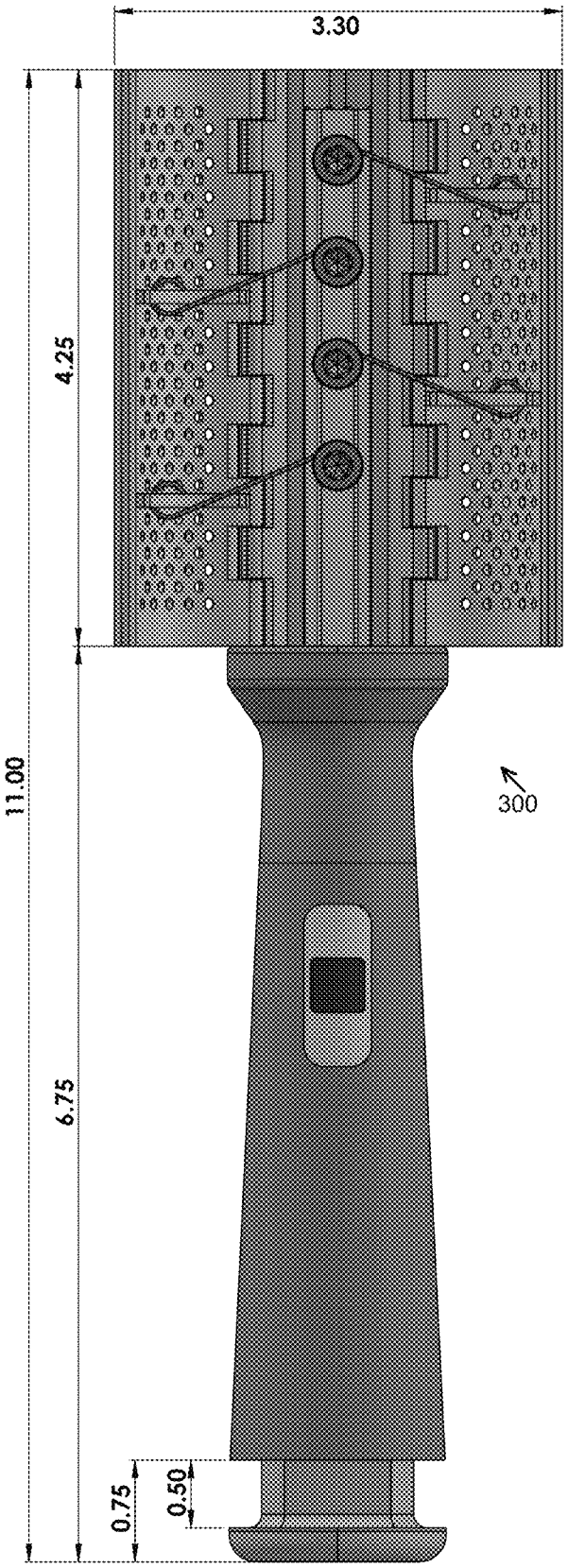

FIGS. 7A-7B are schematic illustrations of several cross-sectional views of the modular hairbrush 300, in its semi-open position, in accordance with some demonstrative embodiments. The numerous bristles (e.g., dozens of bristles) of such hairbrush are not shown, in order to not obscure the details of the other mechanical parts that are shown.

FIGS. 8A-8H are schematic illustrations of several views of the modular hairbrush 300, in its semi-open position, in accordance with some demonstrative embodiments. The numerous bristles (e.g., dozens of bristles) of such hairbrush are not shown, in order to not obscure the details of the other mechanical parts that are shown.

Figure 9A:
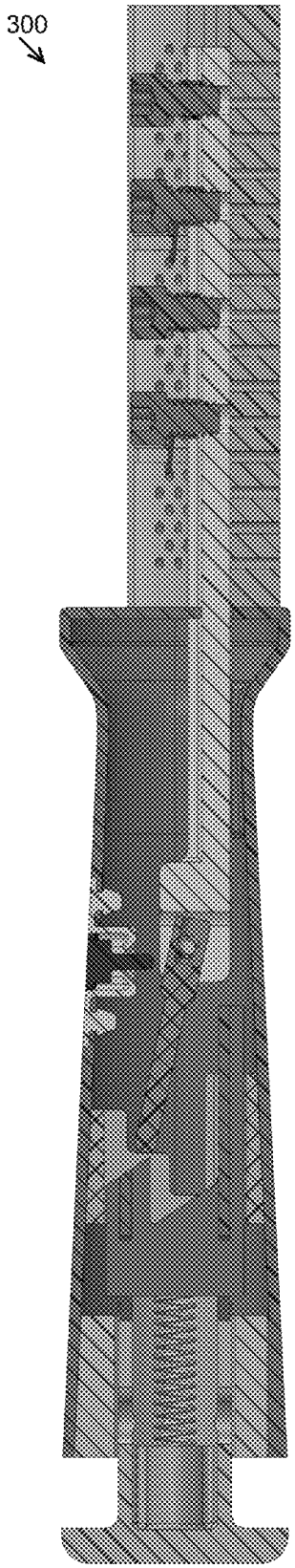
FIGS. 9A-9B are schematic illustrations of several cross-sectional views of the modular hairbrush, in its semi-open position, in accordance with some demonstrative embodiments.
Figure 9B:
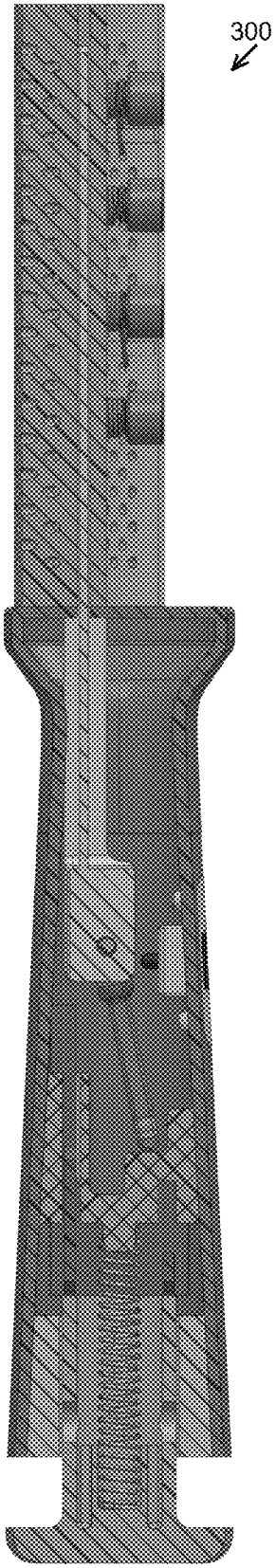
Figure 10A:
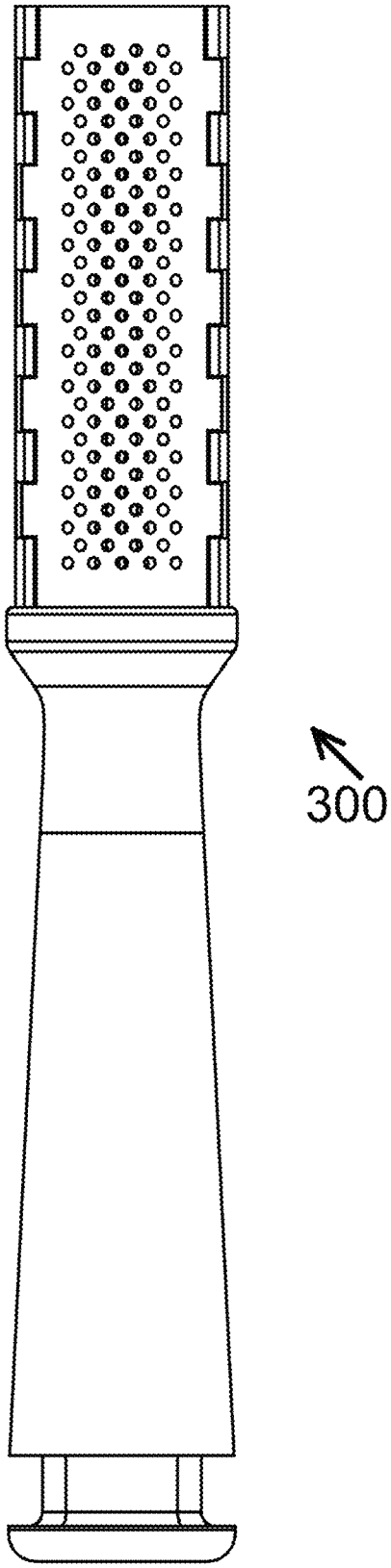
FIGS. 10A-10G are schematic illustrations of several views of the modular hairbrush, in its fully-closed position, in accordance with some demonstrative embodiments.
Figure 10B:
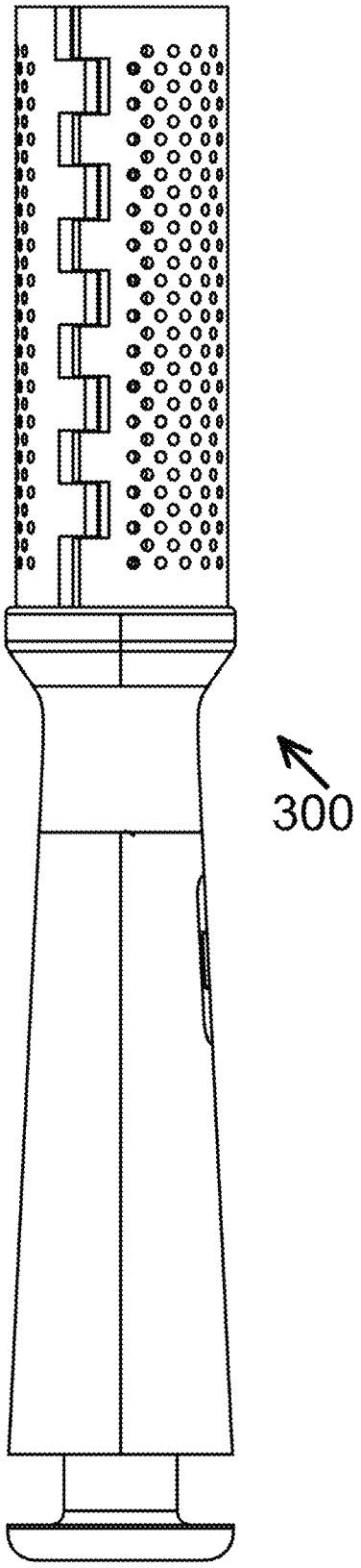
Figure 10C:
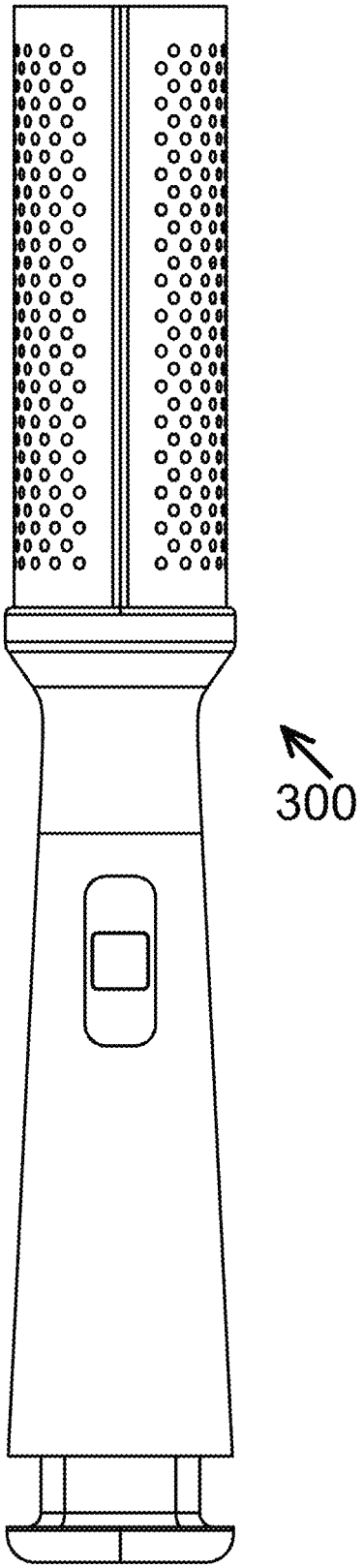
Figure 10D:
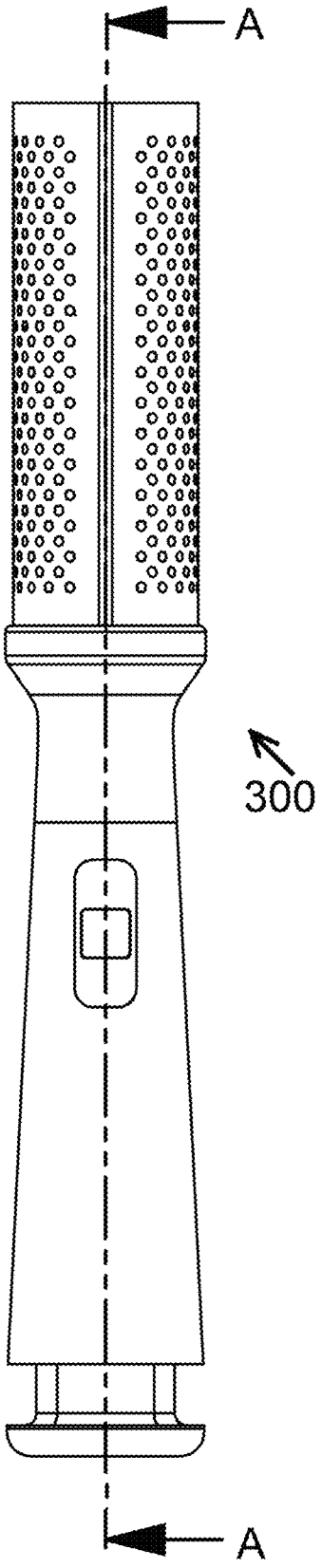
Figure 10E:
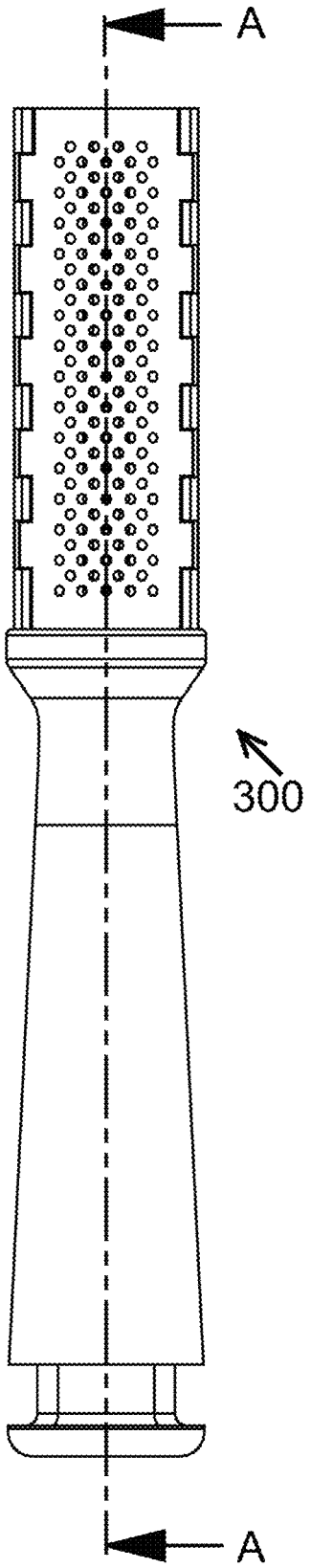
Figure 10F:
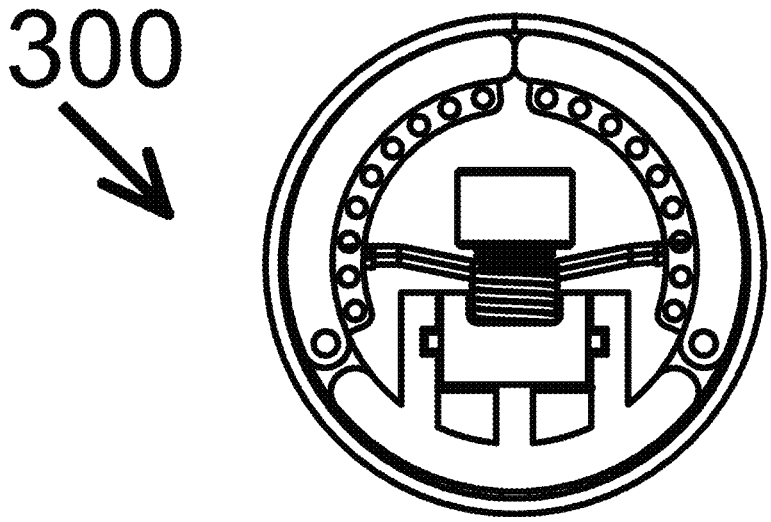
Figure 10G:
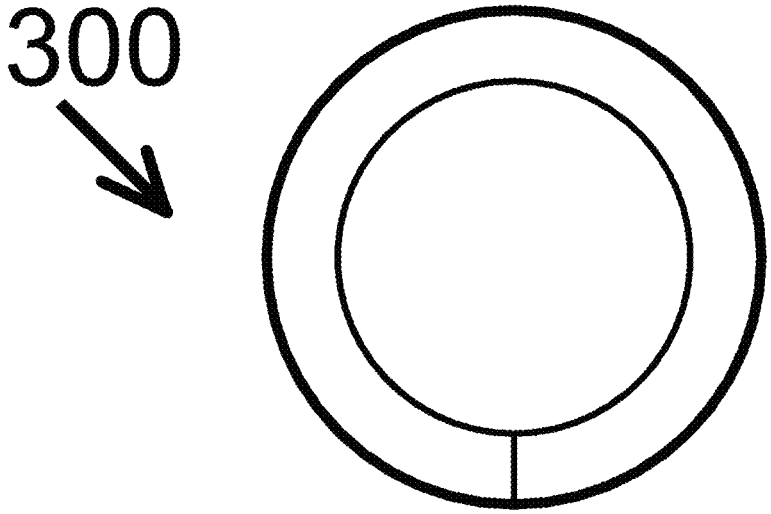
Figure 11A:
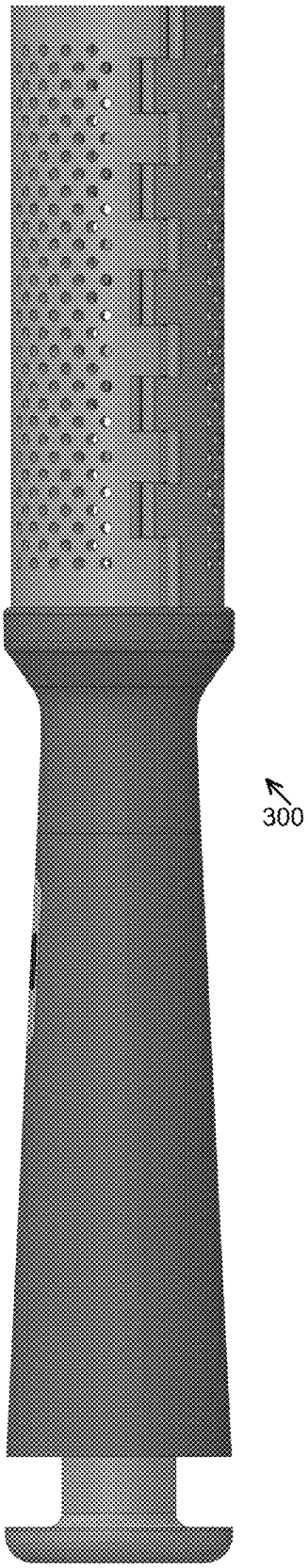
FIGS. 11A-11D are schematic illustrations of several additional views of the modular hairbrush, in its fully-closed position, in accordance with some demonstrative embodiments.
Figure 11B:
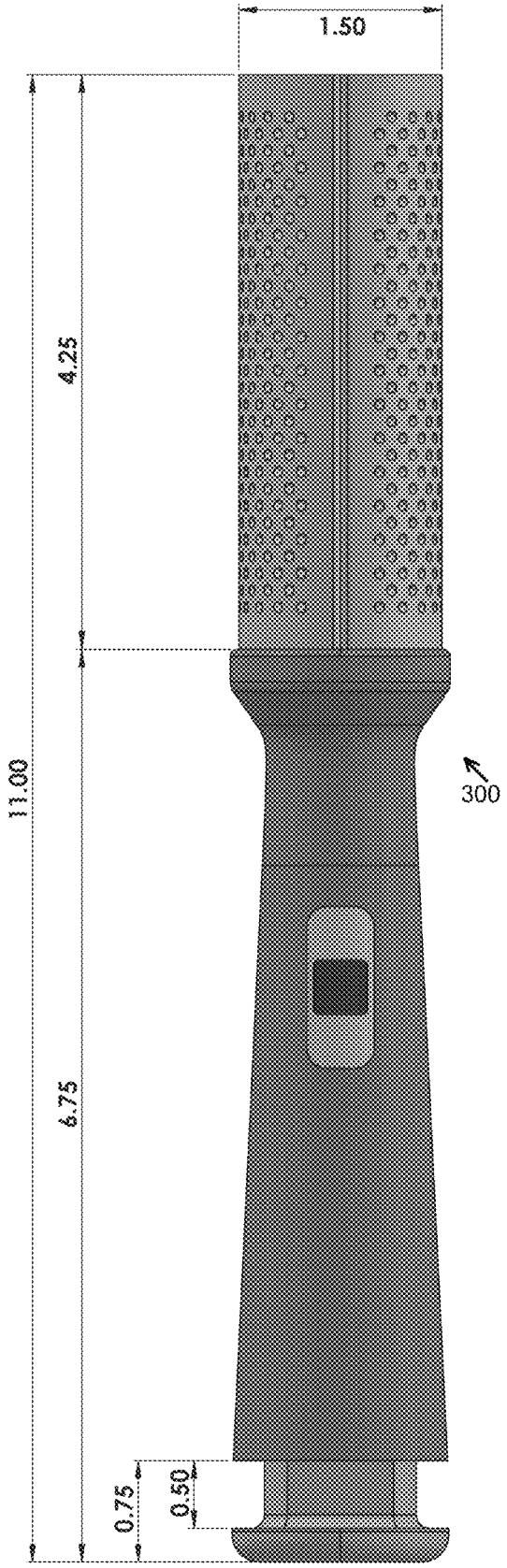
Figure 11C:
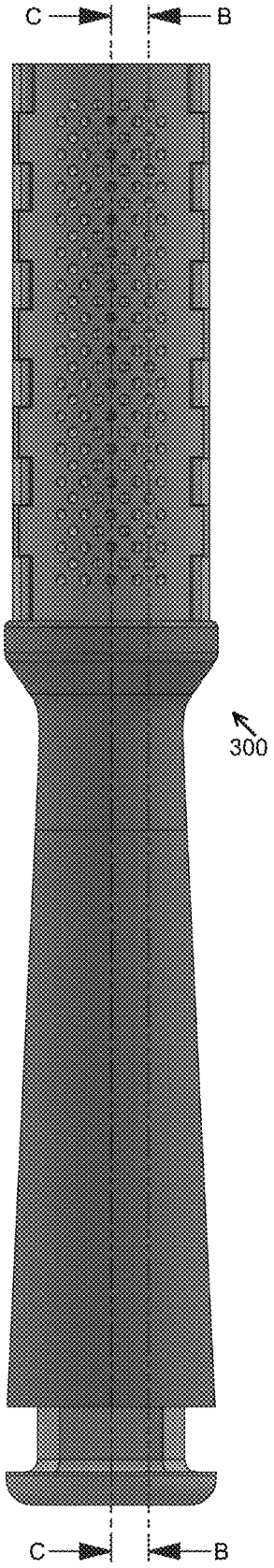
Figure 11D:
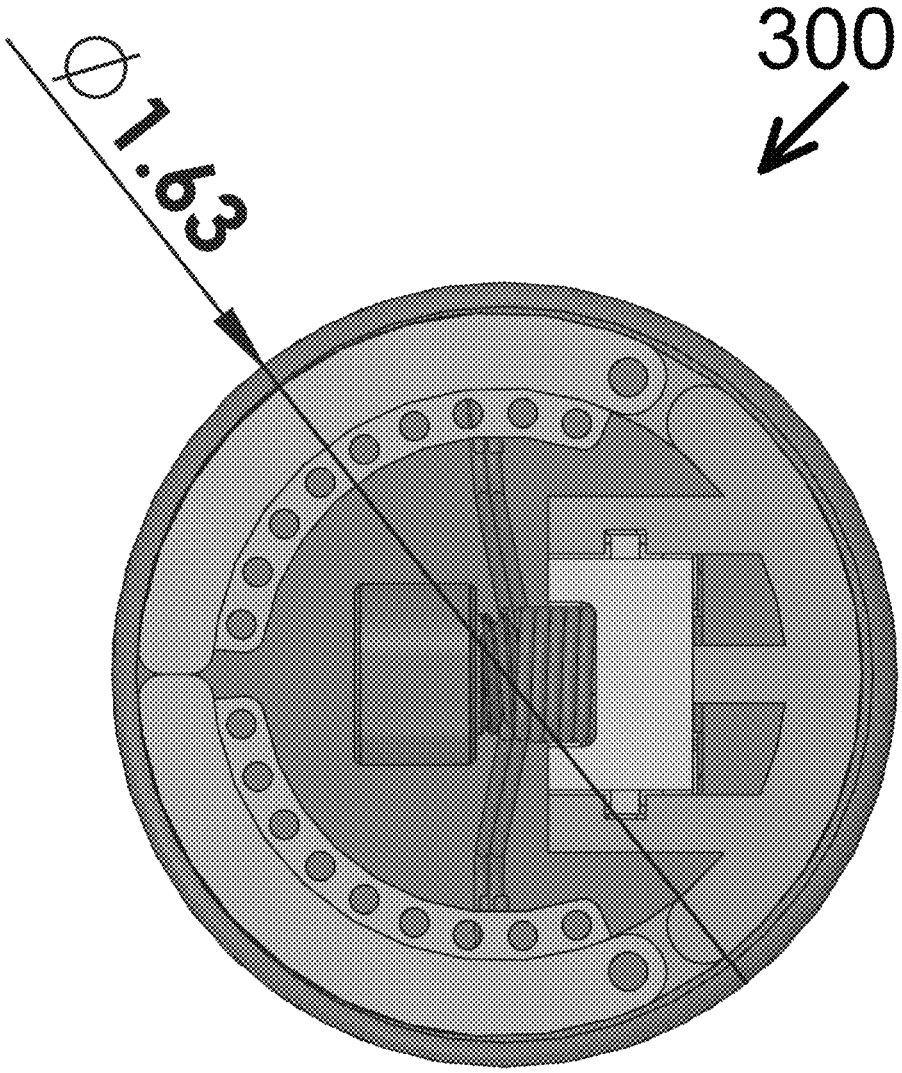
Figure 12A:
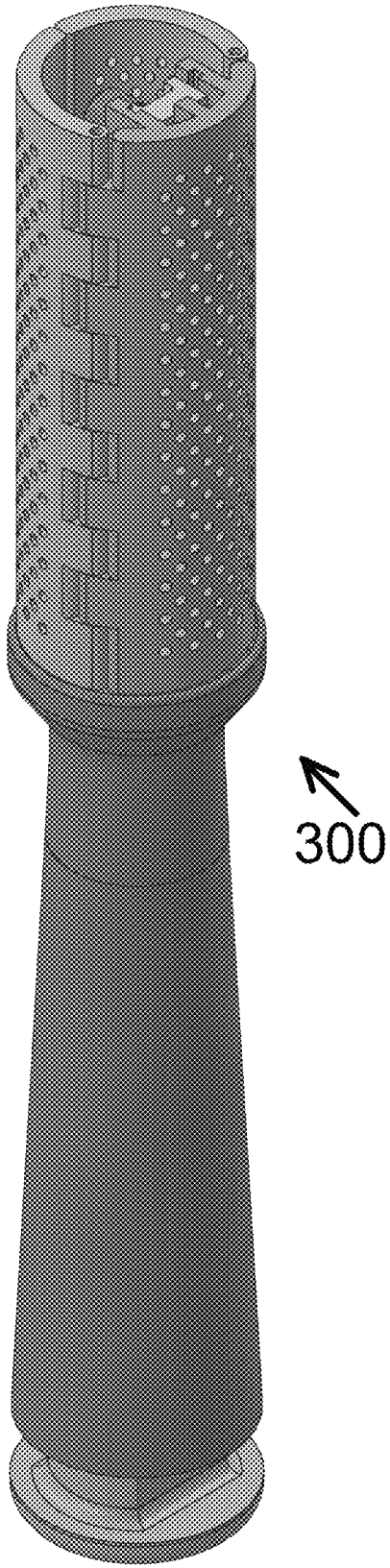
FIGS. 12A-12D are schematic illustrations of several additional views of the modular hairbrush, in its fully-closed position, in accordance with some demonstrative embodiments.
Figure 12B:
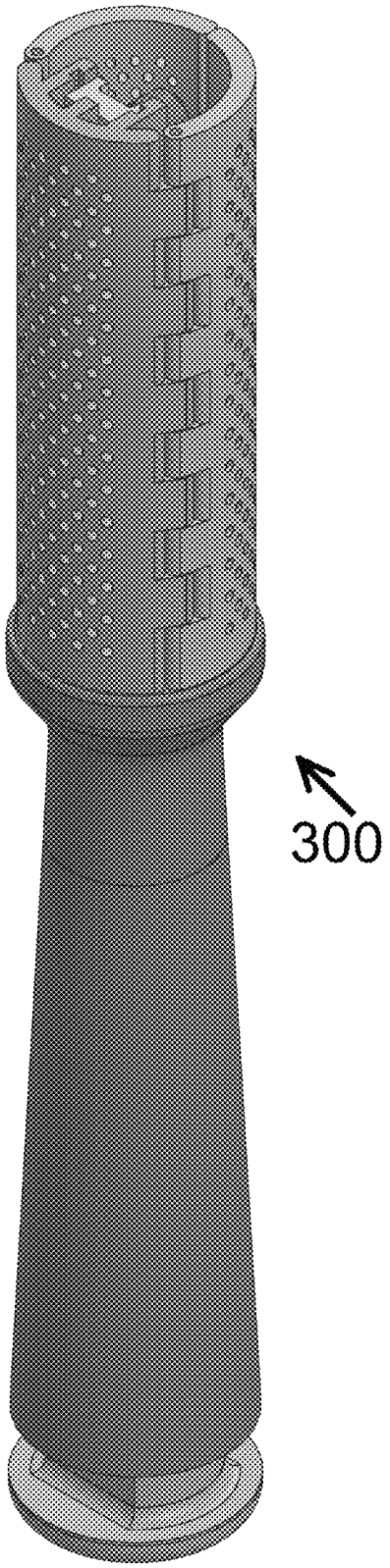
Figure 12C:
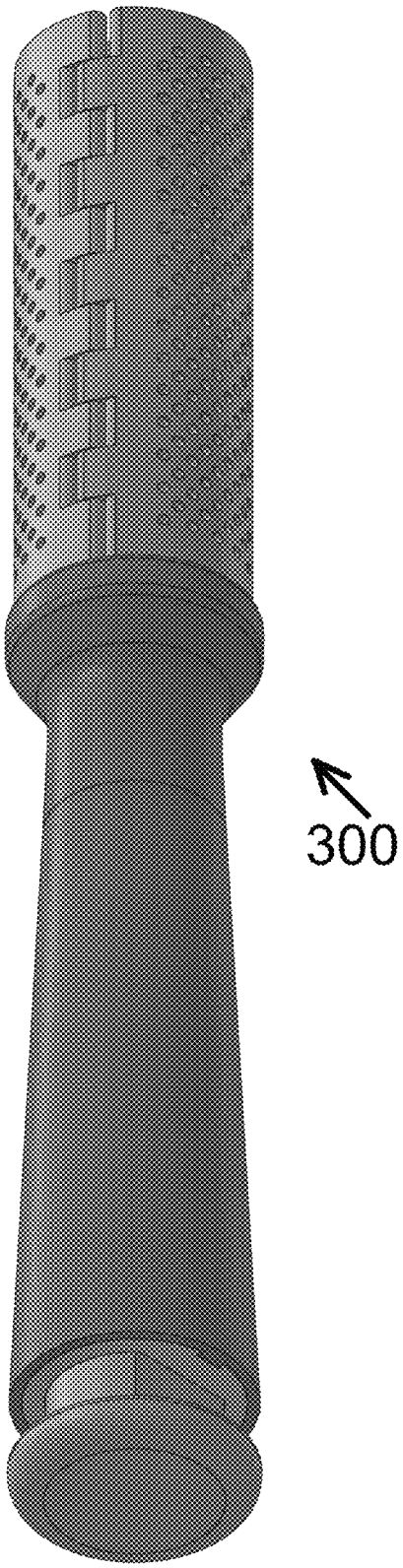
Figure 12D:
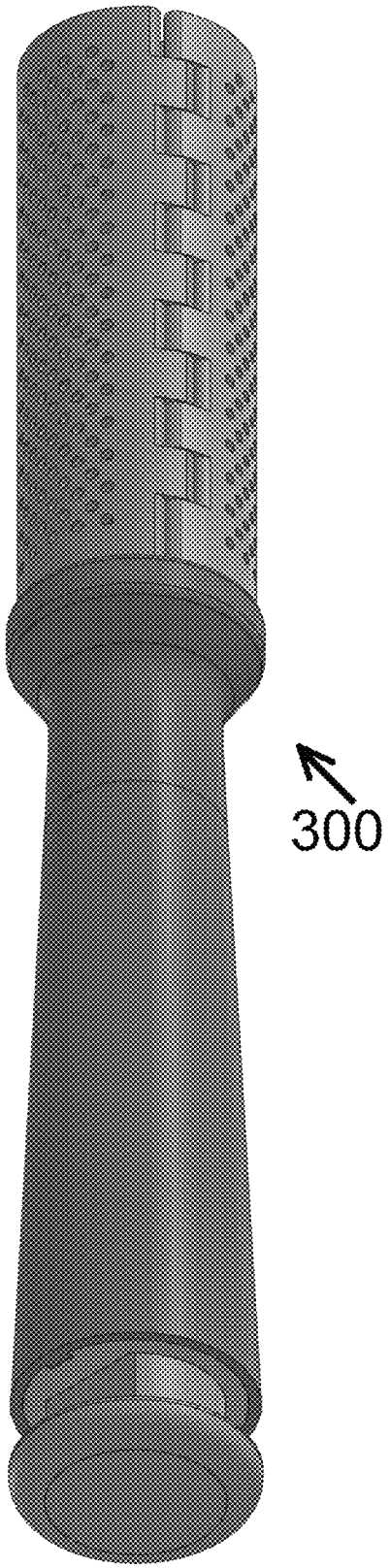
Figure 13A:
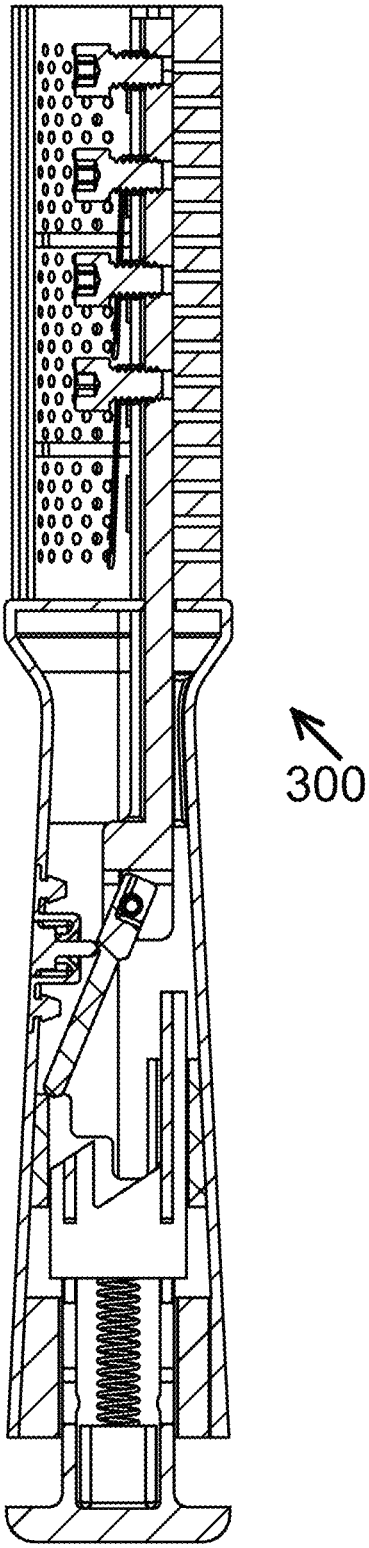
FIGS. 13A-13D are schematic illustrations of several cross-sectional views of the modular hairbrush, in its fully-closed position, in accordance with some demonstrative embodiments.
Figure 13B:
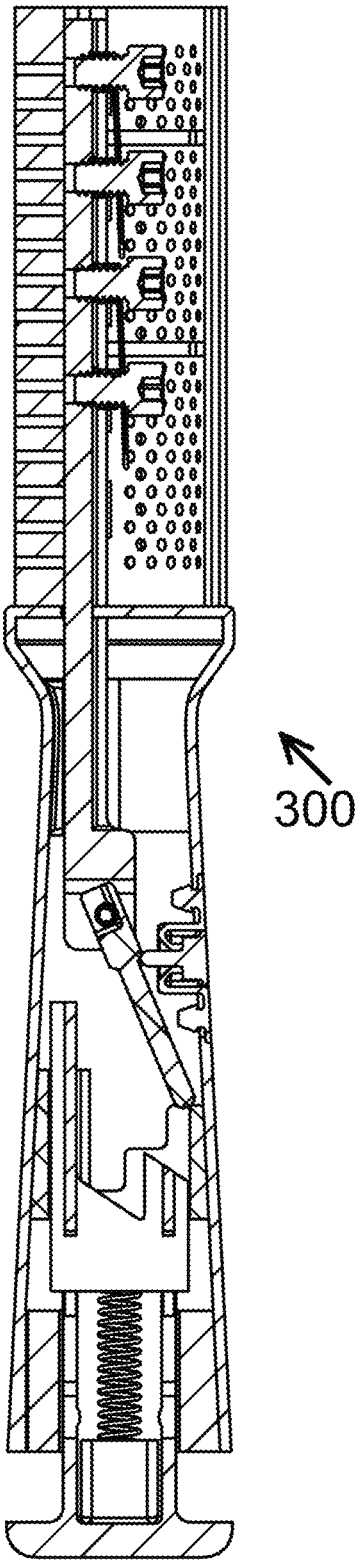
Figure 13C:
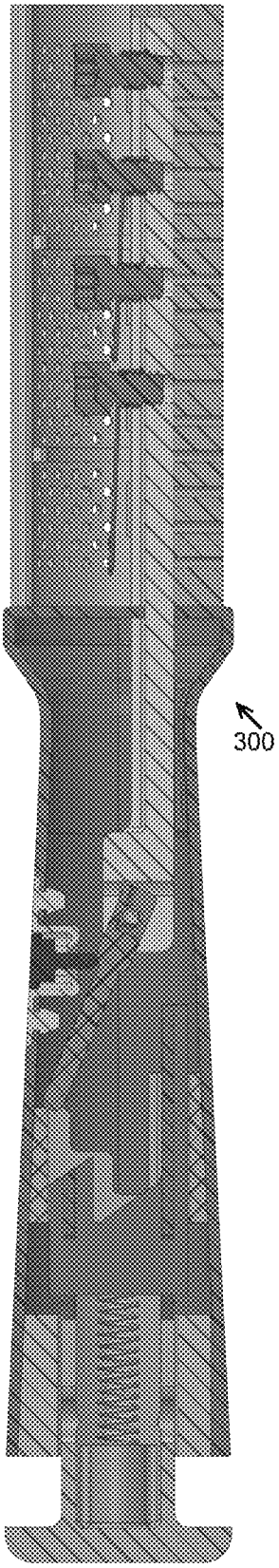
Figure 13D:
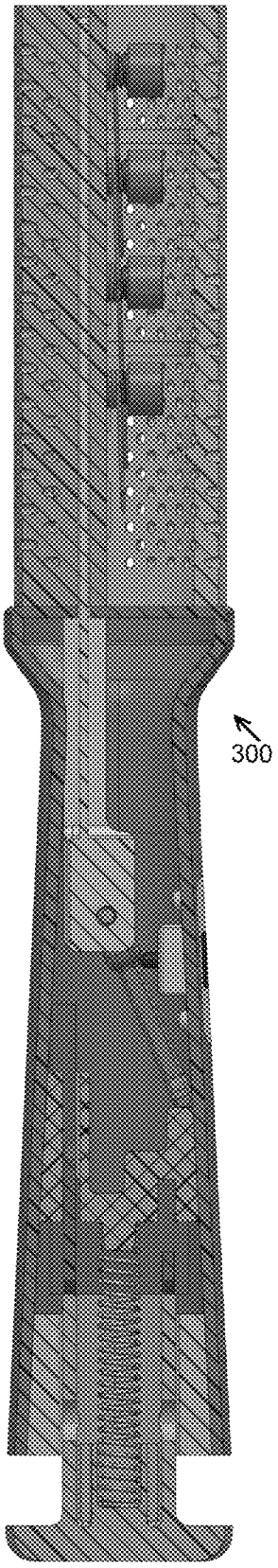

FIGS. 9A-9B are schematic illustrations of several cross-sectional views of the modular hairbrush 300, in its semi-open position, in accordance with some demonstrative embodiments. The numerous bristles (e.g., dozens of bristles) of such hairbrush are not shown, in order to not obscure the details of the other mechanical parts that are shown.

FIGS. 10A-10G are schematic illustrations of several views of the modular hairbrush 300, in its fully-closed position, in accordance with some demonstrative embodiments. The numerous bristles (e.g., dozens of bristles) of such hairbrush are not shown, in order to not obscure the details of the other mechanical parts that are shown.

FIGS. 11A-11D are schematic illustrations of several additional views of the modular hairbrush 300, in its fully-closed position, in accordance with some demonstrative embodiments. The numerous bristles (e.g., dozens of bristles) of such hairbrush are not shown, in order to not obscure the details of the other mechanical parts that are shown.

FIGS. 12A-12D are schematic illustrations of several additional views of the modular hairbrush 300, in its fully-closed position, in accordance with some demonstrative embodiments. The numerous bristles (e.g., dozens of bristles) of such hairbrush are not shown, in order to not obscure the details of the other mechanical parts that are shown.

FIGS. 13A-13D are schematic illustrations of several cross-sectional views of the modular hairbrush 300, in its fully-closed position, in accordance with some demonstrative embodiments. The numerous bristles (e.g., dozens of bristles) of such hairbrush are not shown, in order to not obscure the details of the other mechanical parts that are shown.

Figure 14:
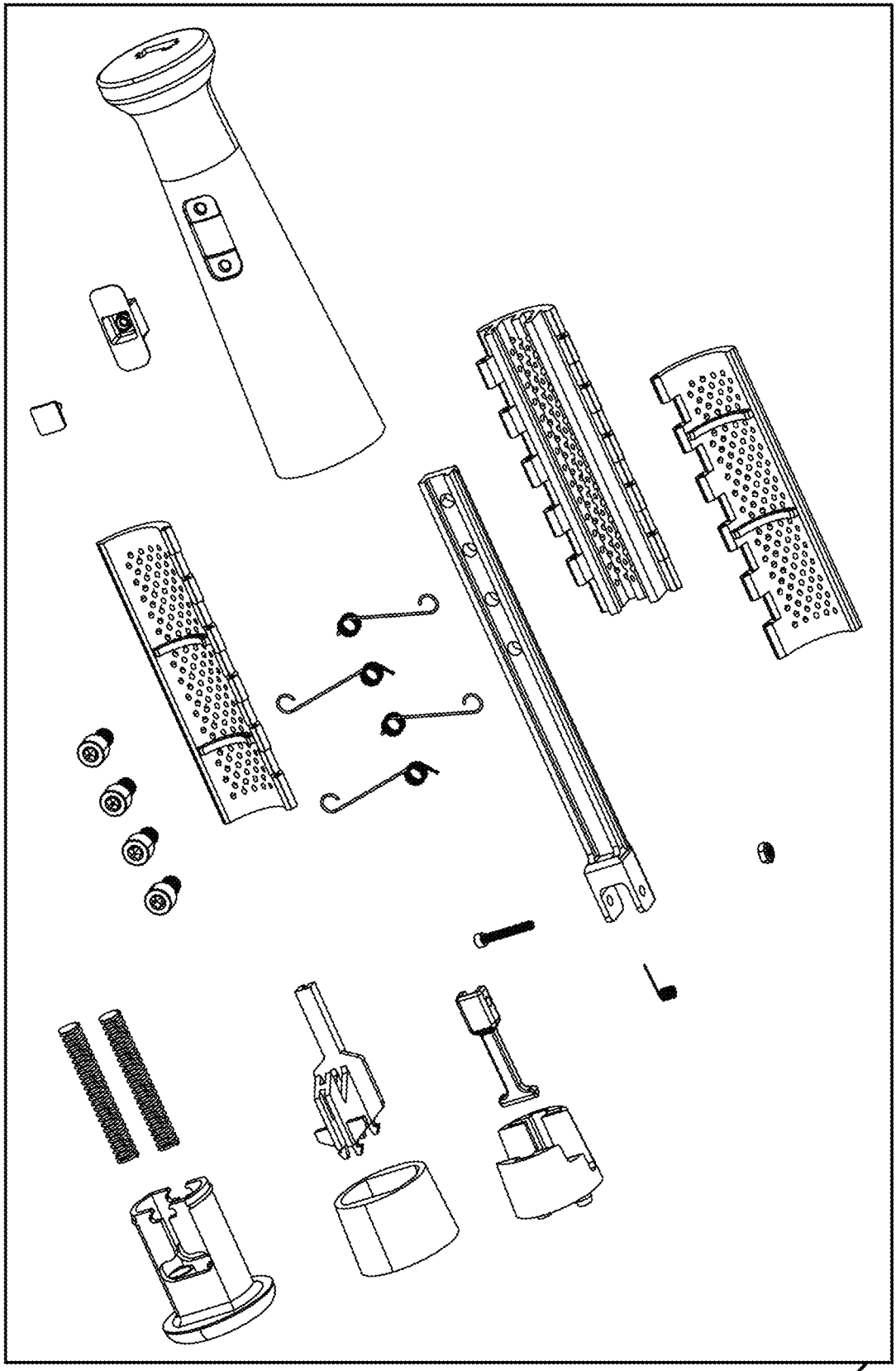
FIG. 14 is a schematic illustration of a set of components of the modular hairbrush, in accordance with some demonstrative embodiments.

FIG. 14 is a schematic illustration of a set 1400 of components of the modular hairbrush, in accordance with some demonstrative embodiments. The numerous bristles (e.g., dozens of bristles) of such hairbrush are not shown, in order to not obscure the details of the other mechanical parts that are shown. Optionally, a mechanism utilizing several spring elements or other elastic elements, may be used to implement the expansion and the contraction of the bristle-bed, or to implement the rotation or relative rotation of the panel or bed-regions of the bristle-bed about hinges or about an axis.

Some embodiments provide a tri-position (or multi-position, or multiple-position) hairbrush, comprising: a modular bristle-bed, having a plurality of bristles connected thereto; a handle (or a grip), connected to (e.g., beneath) the modular bristle-bed; a switching unit, to switch and convert the modular bristle-bed among a first operational state, a second operational state, and a third operational state; wherein, in the first operational state, which is a Closed State, the modular bristle-bed is arranged at a cylindrical or barrel-shaped structure, and the tri-position hairbrush is operable as a round hairbrush; wherein, in the second operational state, which is a Semi-Open State, the modular bristle-bed is arranged at a curved cylinder-portion of 150 to 210 degrees of curvature, and the tri-position hairbrush is operable as an open-curve hairbrush; wherein, in the third operational state, which is a Fully-Open State, the modular bristle-bed is arranged as a flat or generally-flat surface, and the tri-position hairbrush is operable as a paddle hairbrush.

In some embodiments, the switching unit, upon engagement in a first direction, is operable to convert the modular bristle-bed from the first operational state to the second operational state, and then from the second operational state to the third operational state; wherein the switching unit, upon engagement in a second direction that is opposite the first direction, is operable to convert the modular bristle-bed from the third operational state to the second operational state, and then from the second operational state to the first operational state.

In some embodiments, the switching unit comprises, or is operably associated with, a locking mechanism to selectively lock the modular bristle-bed into one operational state of the first operational state, the second operational state, and the third operational state.

In some embodiments, the switching unit and the locking unit comprise a ratchet and pawl mechanism, which enables the modular bristle-bed to open and close at least one surface of the modular bristle-bed, and which enables selective locking of the modular bristle-bed into one operational state of the first operational state, the second operational state, and the third operational state.

In some embodiments, the modular bristle-bed comprises three bed-regions; wherein each of the three bed-regions spans 120 degrees, and the three bed-regions together span 360 degrees; wherein a first set of hinges connect a right-side bed-region to a central bed-region; wherein a second set of hinges connect a left-side bed-region to the central bed-region; wherein the left-side bed-region is not connected to the right-side bed-region in any of the first operational state, the second operational state, and the third operational state.

In some embodiments, the left-side bed-region is not connected to (or, is not touching) the right-side bed-region in any of the first operational state, the second operational state, and the third operational state.

In some embodiments, the switching mechanism re-arranges the three bed-regions, (i) to form a first arrangement that is circular in the first operational state, and (ii) to form a second arrangement that is structured as a portion of a circle in the second operational state, and (iii) to form a third arrangement that is generally flat in the third operational state.

In some embodiments, the modular bristle-bed comprises three bed-regions; wherein each of the three bed-regions spans a spatial arc in the range of 110 to 120 degrees, and the three bed-regions together span a spatial arc in the range of 330 to 360 degrees; wherein a first set of hinges connect a right-side bed-region to a central bed-region; wherein a second set of hinges connect a left-side bed-region to the central bed-region; wherein the left-side bed-region is not connected to the right-side bed-region in any of the first operational state, the second operational state, and the third operational state; wherein the left-side bed-region is not connected to the right-side bed-region in any of the first operational state, the second operational state, and the third operational state.

In some embodiments, the switching mechanism, when engaged by the user, gradually and non-abruptly re-arranges the three bed-regions to be at a different angle relative to each other, in a continuous rearrangement manner and not in accordance with a finite plurality of discrete rearrangement positions; wherein a locking mechanism of the tri-position hairbrush, when engaged by the user, locks a current spatial arrangement of the three bed-regions and causes the three bed-regions to be non-movable and non-rotating relative to each other.

In some embodiments, the switching mechanism, when engaged by the user, non-gradually (e.g., and abruptly) re-arranges the three bed-regions to be at a different angle relative to each other out of three discrete and pre-defined spatial arrangements; wherein a locking mechanism of the tri-position hairbrush, when engaged by the user, locks a current spatial arrangement of the three bed-regions and causes the three bed-regions to be non-movable and non-rotating relative to each other.

In some embodiments, the bristles are connected directly to, and are rooted at, the three bed-regions that form the modular bristle-bed.

In some embodiments, the bristles are connected directly to, and are rooted at, a soft interim layer that externally covers the three bed-regions that form the modular bristle-bed.

In some embodiments, the switching mechanism comprises at least a central gear, that is rotatable via user engagement therewith; wherein the central gear touches and rotates a plurality of secondary gears, wherein each of the secondary gears causes rotation of one bed-region relative to another, neighboring, bed-region about a set of one or more hinges.

In some embodiments, the switching mechanism comprises at least a central gear, that is rotatable via user engagement therewith; wherein the central gear touches and rotates a plurality of secondary gears, wherein each of the secondary gears causes rotation of one bed-region relative to another, neighboring, bed-region about a set of one or more hinges; wherein a ratchet-and-pawl mechanism, upon engagement by the user, locks the three bed-regions into a non-movable spatial arrangement.

In some embodiments, the switching mechanism comprises at least a central gear, that is rotatable via user engagement therewith; wherein the central gear is internal to said hairbrush, and engages with a partially-external gear that is partially within the hairbrush, wherein manual rotation of the partially-external gear causes rotation of the central gear within the hairbrush; wherein the central gear touches and rotates a plurality of secondary gears, wherein each of the secondary gears causes rotation of one bed-region relative to another, neighboring, bed-region about a set of one or more hinges.

In some embodiments, the switching mechanism comprises at least: (i) a central gear, that is rotatable via a battery-powered electric motor that is internal to said hairbrush, and (ii) an actuation unit to actuate the battery-powered electric motor in response to a user engagement with the actuation unit; wherein the central gear touches and rotates a plurality of secondary gears, wherein each of the secondary gears causes rotation of one bed-region relative to another, neighboring, bed-region about a set of one or more hinges.

In some embodiments, the switching mechanism is located at a top half region of the handle of the tri-position hairbrush.

In some embodiments, the switching mechanism is located above the handle of the tri-position hairbrush, and is located at or within the bristle-bed of the modular tri-position hairbrush.

In some embodiments, the switching mechanism comprises a vertical mechanical slider, capable of moving from a first vertical position to a second vertical position to a third vertical position; wherein the first vertical position of the vertical mechanical slider arranges and holds the modular bristle-bed at the Closed State; wherein the second vertical position of the vertical mechanical slider arranges and holds the modular bristle-bed at the Semi-Open State; wherein the third vertical position of the vertical mechanical slider arranges and holds the modular bristle-bed at the Fully-Open State.

In some embodiments, the switching mechanism comprises a horizontally-rotating gear, having an axis of rotation that is perpendicular to a longest dimension of the tri-position hairbrush; wherein the horizontally-rotating gear is capable of moving among at least a first vertical position, a second vertical position, and a third vertical position; wherein the first vertical position of the horizontally-rotating gear arranges and holds the modular bristle-bed at the Closed State; wherein the second vertical position of the horizontally-rotating gear arranges and holds the modular bristle-bed at the Semi-Open State; wherein the third vertical position of the horizontally-rotating gear arranges and holds the modular bristle-bed at the Fully-Open State.

Some embodiments provide a tri-position hairbrush that includes a modular bristle-bed, having a plurality of bristles connected thereto; and a handle, connected to the modular bristle-bed. A switching unit operates to switch and convert the modular bristle-bed among three operational states. In a first operational state, which is a Closed State, the modular bristle-bed is arranged as a cylindrical structure that spans 330 to 360 degrees of curvature, and the hairbrush operates a round hairbrush. In a second operational state, which is a Semi-Open State, the modular bristle-bed is arranged as a curved cylinder-portion of 150 to 210 degrees of curvature, and the hairbrush operates as an open-curve hairbrush. In a third operational state, which is a Fully-Open State, the modular bristle-bed is arranged as a generally-flat surface, and the hairbrush operates as a paddle hairbrush.

The terms "plurality" and "a plurality", as used herein, include, for example, "multiple" or "two or more". For example, "a plurality of items" includes two or more items.

References to "one embodiment", "an embodiment", "demonstrative embodiment", "various embodiments", "some embodiments", and/or similar terms, may indicate that the embodiment(s) so described may optionally include a particular feature, structure, or characteristic, but not every embodiment necessarily includes the particular feature, structure, or characteristic. Repeated use of the phrase "in one embodiment" does not necessarily refer to the same embodiment, although it may. Repeated use of the phrase "in some embodiments" does not necessarily refer to the same set or group of embodiments, although it may.

As used herein, and unless otherwise specified, the utilization of ordinal adjectives such as "first", "second", "third", "fourth", and so forth, to describe an item or an object, merely indicates that different instances of such like items or objects are being referred to; and does not intend to imply as if the items or objects so described must be in a particular given sequence, either temporally, spatially, in ranking, or in any other ordering manner.

Functions, operations, components and/or features described herein with reference to one or more embodiments, may be combined with, or may be utilized in combination with, one or more other functions, operations, components and/or features described herein with reference to one or more other embodiments. Some embodiments may comprise any possible combinations, re-arrangements, assembly, re-assembly, or other utilization of some or all of the modules or functions or components that are described herein, even if they are discussed in different locations or different chapters of the above discussion, or even if they are shown across different drawings or multiple drawings.

While certain features of some embodiments have been illustrated and described herein, many modifications, substitutions, changes, and equivalents may occur to those skilled in the art. Accordingly, the claims are intended to cover all such modifications, substitutions, changes, and equivalents.

What is claimed is:

1. A tri-position hairbrush, comprising:

a modular bristle-bed, having a plurality of bristles connected thereto;

a handle, connected to the modular bristle-bed;

a switching unit, to switch and convert the modular bristle-bed among a first operational state, a second operational state, and a third operational state;

wherein, in the first operational state, which is a Closed State, the modular bristle-bed is arranged at a cylindrical or barrel-shaped structure, and the tri-position hairbrush is operable as a round hairbrush;

wherein, in the second operational state, which is a Semi-Open State, the modular bristle-bed is arranged at a curved cylinder-portion of 150 to 210 degrees of curvature, and the tri-position hairbrush is operable as an open-curve hairbrush;

wherein, in the third operational state, which is a Fully-Open State, the modular bristle-bed is arranged as a flat or generally-flat surface, and the tri-position hairbrush is operable as a paddle hairbrush.

2. The tri-position hairbrush of claim 1, wherein the switching unit, upon engagement in a first direction, is operable to convert the modular bristle-bed from the first operational state to the second operational state, and then from the second operational state to the third operational state;

wherein the switching unit, upon engagement in a second direction that is opposite the first direction, is operable to convert the modular bristle-bed from the third operational state to the second operational state, and then from the second operational state to the first operational state.

3. The tri-position hairbrush of claim 1, wherein the switching unit comprises, or is operably associated with, a locking mechanism to selectively lock the modular bristle-bed into one operational state of the first operational state, the second operational state, and the third operational state.

4. The tri-position hairbrush of claim 1, wherein the switching unit and the locking unit comprise a ratchet and pawl mechanism, which enables the modular bristle-bed to open and close at least one surface of the modular bristle-bed, and which enables selective locking of the modular bristle-bed into one operational state of the first operational state, the second operational state, and the third operational state.

5. The tri-position hairbrush of claim 1, wherein the modular bristle-bed comprises three bed-regions, wherein each of the three bed-regions spans 120 degrees, and the three bed-regions together span 360 degrees, wherein a first set of hinges connect a right-side bed-region to a central bed-region, wherein a second set of hinges connect a left-side bed-region to the central bed-region, wherein the left-side bed-region is not connected to the right-side bed-region in any of the first operational state, the second operational state, and the third operational state.

6. The tri-position hairbrush of claim 5, wherein the left-side bed-region is not connected to the right-side bed-region in any of the first operational state, the second operational state, and the third operational state.

7. The tri-position hairbrush of claim 6, wherein the switching mechanism re-arranges the three bed-regions (i) to form a first arrangement that is circular in the first operational state, and (ii) to form a second arrangement that is structured as a portion of a circle in the second operational state, and (iii) to form a third arrangement that is generally flat in the third operational state.

8. The tri-position hairbrush of claim 1, wherein the modular bristle-bed comprises three bed-regions, wherein each of the three bed-regions spans a spatial arc in the range of 110 to 120 degrees, and the three bed-regions together span a spatial arc in the range of 330 to 360 degrees, wherein a first set of hinges connect a right-side bed-region to a central bed-region, wherein a second set of hinges connect a left-side bed-region to the central bed-region, wherein the left-side bed-region is not connected to the right-side bed-region in any of the first operational state, the second operational state, and the third operational state;

wherein the left-side bed-region is not connected to the right-side bed-region in any of the first operational state, the second operational state, and the third operational state.

9. The tri-position hairbrush of claim 6, wherein the switching mechanism, when engaged by the user, gradually and non-abruptly re-arranges the three bed-regions to be at a different angle relative to each other, in a continuous rearrangement manner and not in accordance with a finite plurality of discrete rearrangement positions;

wherein a locking mechanism of the tri-position hairbrush, when engaged by the user, locks a current spatial arrangement of the three bed-regions and causes the three bed-regions to be non-movable and non-rotating relative to each other.

10. The tri-position hairbrush of claim 6, wherein the switching mechanism, when engaged by the user, non-gradually re-arranges the three bed-regions to be at a different angle relative to each other out of three discrete and pre-defined spatial arrangements;

wherein a locking mechanism of the tri-position hairbrush, when engaged by the user, locks a current spatial arrangement of the three bed-regions and causes the three bed-regions to be non-movable and non-rotating relative to each other.

11. The tri-position hairbrush of claim 6, wherein the bristles are connected directly to, and are rooted at, the three bed-regions that form the modular bristle-bed.

12. The tri-position hairbrush of claim 6, wherein the bristles are connected directly to, and are rooted at, a soft interim layer that externally covers the three bed-regions that form the modular bristle-bed.

13. The tri-position hairbrush of claim 6, wherein the switching mechanism comprises at least a central gear, that is rotatable via user engagement therewith, wherein the central gear touches and rotates a plurality of secondary gears, wherein each of the secondary gears causes rotation of one bed-region relative to another, neighboring, bed-region about a set of one or more hinges.

14. The tri-position hairbrush of claim 6, wherein the switching mechanism comprises at least a central gear, that is rotatable via user engagement therewith, wherein the central gear touches and rotates a plurality of secondary gears, wherein each of the secondary gears causes rotation of one bed-region relative to another, neighboring, bed-region about a set of one or more hinges;

wherein a ratchet-and-pawl mechanism, upon engagement by the user, locks the three bed-regions into a non-movable spatial arrangement.

15. The tri-position hairbrush of claim 6, wherein the switching mechanism comprises at least a central gear, that is rotatable via user engagement therewith;

wherein the central gear is internal to said hairbrush, and engages with a partially-external gear that is partially within the hairbrush, wherein manual rotation of the partially-external gear causes rotation of the central gear within the hairbrush;

wherein the central gear touches and rotates a plurality of secondary gears, wherein each of the secondary gears causes rotation of one bed-region relative to another, neighboring, bed-region about a set of one or more hinges.

16. The tri-position hairbrush of claim 6, wherein the switching mechanism comprises at least: (i) a central gear, that is rotatable via a battery-powered electric motor that is internal to said hairbrush, and (ii) an actuation unit to actuate the battery-powered electric motor in response to a user engagement with the actuation unit;

wherein the central gear touches and rotates a plurality of secondary gears, wherein each of the secondary gears causes rotation of one bed-region relative to another, neighboring, bed-region about a set of one or more hinges.

17. The tri-position hairbrush of claim 1, wherein the switching mechanism is located at a top half region of the handle of the tri-position hairbrush.

18. The tri-position hairbrush of claim 1, wherein the switching mechanism is located above the handle of the tri-position hairbrush, and is located at or within the bristle-bed of the modular tri-position hairbrush.

19. The tri-position hairbrush of claim 1, wherein the switching mechanism comprises a vertical mechanical slider, capable of moving from a first vertical position to a second vertical position to a third vertical position;

wherein the first vertical position of the vertical mechanical slider arranges and holds the modular bristle-bed at the Closed State;

wherein the second vertical position of the vertical mechanical slider arranges and holds the modular bristle-bed at the Semi-Open State;

wherein the third vertical position of the vertical mechanical slider arranges and holds the modular bristle-bed at the Fully-Open State.

20. The tri-position hairbrush of claim 1, wherein the switching mechanism comprises a horizontally-rotating gear, having an axis of rotation that is perpendicular to a longest dimension of the tri-position hairbrush;

wherein the horizontally-rotating gear is capable of moving among at least a first vertical position, a second vertical position, and a third vertical position;

wherein the first vertical position of the horizontally-rotating gear arranges and holds the modular bristle-bed at the Closed State;

wherein the second vertical position of the horizontally-rotating gear arranges and holds the modular bristle-bed at the Semi-Open State;

wherein the third vertical position of the horizontally-rotating gear arranges and holds the modular bristle-bed at the Fully-Open State.

* * * * *